US006480614B1

(12) United States Patent
Denda et al.

(10) Patent No.: US 6,480,614 B1
(45) Date of Patent: Nov. 12, 2002

(54) PLANAR ACOUSTIC TRANSDUCER

(75) Inventors: Sakuzo Denda, Nagano (JP); Toshiiku Miyazaki, Omiya (JP)

(73) Assignee: FPS, Inc., Tokyo (JP)

( * ) Notice: Subject to any disclaimer, the term of this patent is extended or adjusted under 35 U.S.C. 154(b) by 0 days.

(21) Appl. No.: 09/445,224

(22) PCT Filed: Jun. 5, 1998

(86) PCT No.: PCT/JP98/02503

§ 371 (c)(1),
(2), (4) Date: Dec. 6, 1999

(87) PCT Pub. No.: WO99/03304

PCT Pub. Date: Jan. 21, 1999

(30) Foreign Application Priority Data

Jul. 9, 1997 (JP) ..... 9-197971
Jul. 29, 1997 (JP) ..... 9-007122

(51) Int. Cl.[7] ..... H04R 25/00
(52) U.S. Cl. ..... 381/423; 381/191
(58) Field of Search ..... 381/176, 177, 381/191, 396, 399, 431, 423

(56) References Cited

U.S. PATENT DOCUMENTS

| | | | | |
|---|---|---|---|---|
| 3,164,686 | A | * 1/1965 | Tibbetts | 381/431 |
| 3,997,739 | A | * 12/1976 | Kishikawa et al. | |
| 4,210,786 | A | * 7/1980 | Winey | |
| 4,228,327 | A | * 10/1980 | Sawafuji | 381/431 |
| 4,242,541 | A | * 12/1980 | Ando | 381/191 |
| 4,384,173 | A | * 5/1983 | Briefer et al. | 381/431 |
| 5,003,610 | A | * 3/1991 | Adachi et al. | 381/191 |
| 5,953,438 | A | * 9/1999 | Stevenson et al. | 381/431 |
| 6,097,830 | A | * 8/2000 | Zelinka et al. | 381/431 |

FOREIGN PATENT DOCUMENTS

| | | | |
|---|---|---|---|
| JP | U 52-60828 | | 5/1977 |
| JP | A 54-51518 | | 4/1979 |
| JP | U 55-148293 | | 10/1980 |
| JP | U 56-85490 | | 7/1981 |
| JP | U 57-10185 | | 1/1982 |
| JP | 58080999 | A * | 5/1983 |
| JP | U 59-56898 | | 4/1984 |
| JP | U 61-111292 | | 7/1986 |
| JP | A 63-151296 | | 6/1988 |
| JP | A 5-91591 | | 4/1993 |
| JP | WO 99/03304 | A1 * | 1/1999 |
| JP | 2000152378 | A * | 5/2000 |

* cited by examiner

*Primary Examiner*—Curtis Kuntz
*Assistant Examiner*—P. Dabney
(74) *Attorney, Agent, or Firm*—Oliff & Berridge PLC

(57) ABSTRACT

Permanent magnets m18, m28 and m38 each of which is formed in a flat and rectangular shape are disposed on a yoke 20 with the magnetic pole surfaces facing upwardly so that the magnetic pole surfaces whose polarities are different are disposed alternately. A vibrating diaphragm 26 is disposed on the top surface of the yoke 20 so as to be in parallel with the magnetic pole surfaces of the permanent magnets. Pairs of coils L18, L28 and L38 which are wound in a swirled shape and are disposed at the top and rear surfaces of the vibrating diaphragm are disposed on the vibrating diaphragm 26 so as to correspond to the permanent magnets m28 and m38, respectively. Each of the pairs of coils L18, L28 and L38 is wound in a swirled shape so as to be substantially analogous with the external edge of the magnetic pole surface of each of the permanent magnets m18, m28 and m38. The internal periphery of each coil is situated at an area which is outside a position corresponding to the external edge of the magnetic pole surface, and the external peripheral portions of the coils do not overlap with each other. As a result, the pairs of coils L18, L28 and L38 link to only the magnetic fields whose orientations are along the surface of the vibrating diaphragm.

26 Claims, 14 Drawing Sheets

PLANAR ACOUSTIC TRANSDUCER

FIELD OF THE INVENTION

The present invention relates to a flat acoustic converting device, and more particularly to a flat acoustic converting device such as a flat speaker, a flat microphone, a flat speaker which can be used as a microphone, a flat speaker which can be used as an antenna or the like.

BACKGROUND OF THE INVENTION

FIG. 1 shows the fundamental structure of a conventional flat speaker. The flat speaker comprises a plurality of bar magnets 1 which are arranged in parallel on a yoke 4, a vibrating diaphragm 2 which is provided to be close to and in parallel with the magnetic pole surfaces of the bar magnets 1, and a plurality of coils 3 each of which is formed on the surface of the vibrating diaphragm 2 at a position which corresponds to the magnetic pole surface of each of the bar magnets. A large portion of the internal periphery of each of the coils 3 is situated at a position facing the magnetic pole surface of each of the bar magnets, and the remaining portion of the coil is positioned outside of the position which corresponds to the external edge of the bar magnet. Alternating currents are supplied into the coils 3 in accordance with Fleming's left-hand rule, and each of the alternating currents is subjected to a force from the magnetic field of each bar magnet. Accordingly, the vibrating diaphragm 2 is vibrated in the direction which is perpendicular to the surface of the vibrating diaphragm 2 so that electric signals can be converted into sound signals.

Further, the vibrating diaphragm 2 is vibrated in the direction which is perpendicular to the surface of the vibrating diaphragm 2 so as to convert sound signals into electrical signals in accordance with Fleming's right-hand rule. Accordingly, this flat speaker can be used as a microphone.

However, in the above-described conventional flat speaker, because a large portion of the coil is disposed at a position on the surface of the vibrating diaphragm so as to face the magnetic pole surface of each bar magnet, a magnetic field whose orientation is perpendicular to the surface of the vibrating diaphragm acts upon the coil portion which is disposed at a position on the surface of the vibrating diaphragm and which faces the magnetic pole surface of the bar magnet. For this reason, the orientation of the force that an electric current supplied into the aforementioned coil portion receives from the magnetic field is along the surface of the vibrating diaphragm. As a result, problems arise in that the force applied along the surface of the vibrating diaphragm causes twisted portions on the surface of the vibrating diaphragm and thereby forms noise components with respect to the sound signals so that the quality of sound may be deteriorated.

Further, since a plurality of bar magnets are disposed in parallel with each other in the longitudinal directions thereof, the length of each of the bar magnets which link to the magnetic field of each coil is approximately twice as long as the product determined by multiplying the value of the longitudinal side of the bar magnet by the number of windings of the coil. The proportion of the surface area of the vibrating diaphragm occupied by the portion of a coil linking to the magnetic field along the length of the longitudinal side of the bar magnets is low. Therefore, there has been a problem that acoustic conversion efficiency deteriorates so that a sufficient amount of volume and a satisfactory quality of sound cannot be obtained.

Further, the configuration of the speaker is determined by the length of each of the bar magnets and the number of the bar magnets disposed on a vibrating diaphragm, the freedom in designing the configuration of a speaker is limited. Moreover, because a coil is disposed for each of the bar magnets along the longitudinal direction thereof, there arises the problem that there is a lack of flexibility in setting the impedance of a speaker to an appropriate value.

The present invention has been accomplished in order to solve the aforementioned drawbacks of the prior art. It is a first object of the present invention to provide a flat acoustic converting device in which the amount of twisted portions which may form on the vibrating diaphragm is decreased so that noise components can be reduced.

Further, it is a second object of the present invention to provide a flat acoustic converting device in which the length of the portion of the coil linking to the magnetic field is made longer, the proportion of the surface area of the vibrating diaphragm occupied by the portion of the coil is increased to enhance acoustic conversion efficiency and improve the quality of sound.

Further, it is a third object of the present invention to provide a flat acoustic converting device whose configuration can be designed with a high degree of freedom, which can be manufactured simply, and in which the impedance of a speaker can be set with high degree of flexibility.

DISCLOSURE OF THE INVENTION

In order to attain the aforementioned objects, the first object of the present invention is a flat acoustic converting device, comprising: a first magnet in which a first magnetic pole surface of the first magnet is disposed so as to be substantially in parallel with a predetermined face; a second magnet which is disposed so as to be spaced apart from the first magnet at a predetermined distance and so as to be adjacent to the first magnet so that a second magnetic pole surface whose polarity is different from the polarity of the first magnetic pole surface is substantially in parallel with the predetermined face and faces the same side as the first magnetic pole surface of the first magnet; a vibrating diaphragm which is disposed so as to face the predetermined face; a first coil which is formed in a swirled shape, and which is disposed on the vibrating diaphragm at a position where the internal peripheral portion of the swirl is situated at an area adjacent to and including a position corresponding to the external edge of the first magnetic pole surface; and a second coil which is formed in a swirled shape, and which is disposed on the vibrating diaphragm at a position where the internal peripheral portion of the swirl is situated at an area adjacent to and including a position corresponding to the external edge of the second magnetic pole surface.

In accordance with the first aspect of the present invention, the first magnet is disposed so that the first magnetic pole surface having the first polarity (for example, N pole) is provided substantially in parallel with the predetermined face. Further, the second magnet is disposed to be spaced apart from the first magnet and to be adjacent thereto so that the second magnetic pole surface having a second polarity (for example, S pole) which is different from the first polarity is disposed so as to be substantially in parallel with the predetermined face and so as to be directed in the same direction as the first magnetic pole surface of the first magnet. Accordingly, the first magnet and the second magnet are provided so as to be adjacent to each other so that each of the magnetic pole surfaces thereof is provided substantially in parallel with the predetermined face, and the magnetic pole surfaces whose polarities are different from each other are directed in the same direction. Moreover, the first and second magnets can be disposed on the predetermined face. However, the external peripheral portions of the first and second magnets can be supported by a frame body or the like.

A vibrating diaphragm is disposed so as to face the predetermined face. Accordingly, the orientation of the magnetic flux which is generated from each of the magnets is from the first magnetic pole surface to the second magnetic pole surface or from the second magnetic pole surface to the first magnetic pole surface. Accordingly, the orientation of the magnetic flux between the first magnetic pole surface and the second magnetic pole surface, i.e., the orientation of the magnetic flux between the first magnet and the second magnet is substantially in parallel with the surface of the vibrating diaphragm.

The first coil and the second coil, each of which is formed in a swirled shape, are provided on the surface of the vibrating diaphragm. The first coil is disposed on the vibrating diaphragm and corresponds to the first magnet so that the internal periphery of the swirl, i.e., the internal periphery of the coil, is situated on the vibrating diaphragm at the area which includes a position which corresponds to the external edge of the first magnetic pole surface and is adjacent to the position which corresponds to the external edge of the first magnetic pole surface. In the same manner as the first coil, the second coil is disposed on the vibrating diaphragm at a position where the internal peripheral portion of the swirl, i.e., the internal peripheral portion of the coil, is situated in the area adjacent to and including the position corresponding to the external edge of the second magnetic pole surface.

In this way, the first and second coils are disposed on the vibrating diaphragm at a position where the internal periphery of each of the coils is situated in the area adjacent to and including the position corresponding to the external edge of the corresponding magnetic pole surface. Further, as described above, because the orientation of the magnetic flux in the area between the first magnet and the second magnet is substantially in parallel with the surface of the vibrating diaphragm, this magnetic flux whose orientation is substantially in parallel with the surface of the vibrating diaphragm 12 acts upon the portion extending from the internal peripheral portion, which is adjacent to the second coil, to the external peripheral portion of the first coil, and also acts upon the portion extending from the internal peripheral portion of the second coil, which is adjacent to the first coil, to the external peripheral portion of the second coil.

For this reason, when currents are supplied into the first and second coils, the direction of the force received by the current from the magnetic field is substantially perpendicular to the surface of the vibrating diaphragm. Accordingly, because the force along the surface of the vibrating diaphragm decreases, the amount of noise components can be reduced and the sound quality can be improved.

In addition, preferably, the vibrating diaphragm is disposed so as to be adjacent to and facing the first magnetic pole surface and the second magnetic pole surface, because it is possible to increase the amount of the magnetic flux which acts upon the portions of the first coil and the second coil adjacent to each other, and which is directed substantially in parallel with the surface of the vibrating diaphragm. It is possible to situate the first coil and the second coil on the vibrating diaphragm slightly internally of the position at which the internal peripheral portion of each of the coils corresponds to the external edge of the magnetic pole surface. However, it is more effective to situate the first and second coils on the vibrating diaphragm at the position at which the internal peripheral portion corresponds to the external edge of the magnetic pole surface, and more preferably, to situate these coils externally of the position at which the internal peripheral portion corresponds to the external edge of the magnetic pole surface. By disposing each h coil in such a manner as described above, since it is possible to increase the components of the magnetic flux linked to the coil which are directed in parallel with the surface of the vibrating diaphragm, vibrating components, i.e., noise components along the surface of the vibrating diaphragm can be greatly reduced and the sound quality can be improved.

Currents running in the same direction are supplied into the portion of the first coil which is adjacent to the second coil and the portion of the second coil which is adjacent to the first coil. Accordingly, the direction of the force received from the magnetic field by the current running from the internal peripheral portion of the first coil which is adjacent to the second coil through to the outer peripheral portion of the first coil is the same as the direction of the force received from the magnetic field by the current running from the internal peripheral portion of the second coil which is adjacent to the first coil through to the outer peripheral portion of the second coil. As a result, it is possible to generate a sound signal having a large amount of volume.

In order to supply currents into the coils in the same direction, it is possible to separately supply currents into the respective coils. However, as will be described hereinafter, it is possible to supply the currents running in the same direction into the portion of the first coil which is adjacent to the second coil and the portion of the second coil which is adjacent to the first coil by connecting the first coil and the second coil to each other. Namely, in the case in which the winding directions from the external periphery to the internal periphery of the first coil and the second coil are the same, as shown in FIGS. 2A and 2B, the internal peripheral ends of the first coil L1 and the second coil L2 are connected to each other, or alternatively, the external peripheral ends of the first coil L1 and the second coil L2 are connected to each other.

If the winding directions from the external periphery to the internal periphery of the first coil and the second coil are different from each other, as shown in FIGS. 3A and 3B, the internal peripheral end of one of the first coil L1 and the second coil L2 is connected to the external peripheral end of the other of the first coil L1 and the second coil L2. Or as shown in FIG. 3C, the internal peripheral ends of the first coil L1 and the second coil L2 are connected to each other, and the external peripheral ends of the first coil L1 and the second coil L2 are connected to each other. Moreover, the arrows in FIGS. 2 and 3 indicate the directions in which currents are energized.

The second aspect of the present invention is a flat acoustic converting device comprising: a first magnet in which a first magnetic pole surface of the first magnet is disposed so as to be substantially in parallel with a predetermined face; a second magnet which is disposed so as to be spaced apart from the first magnet at a predetermined distance and so as to be adjacent to the first magnet so that a second magnetic pole surface whose polarity is different from the polarity of the first magnetic pole is substantially in parallel with the predetermined face and faces the same side as the first magnetic pole surface of the first magnet; a vibrating diaphragm which is disposed so as to face the predetermined face; a first coil which is formed in a swirled shape, and which is disposed on the vibrating diaphragm at a position where the internal peripheral portion of the swirl is situated at an area adjacent to and including a position corresponding to the external edge of the first magnetic pole surface; a second coil which is formed in a swirled shape winding in the reverse direction of the first coil, and which second coil is disposed on the vibrating diaphragm at a position overlapping the first coil in such a way that the internal peripheral portion of the swirl is situated at an area adjacent to and including a position corresponding to the external edge of the first magnetic pole surface, and the internal peripheral end of the second coil is connected to the internal peripheral end of the first coil; a third coil which is formed in a swirled shape winding in the same direction as the second coil, and which third coil is disposed on the vibrating diaphragm in such a way that the internal peripheral portion of the swirl is situated at an area adjacent to and including a position corresponding to the external edge of the second magnetic pole surface, and the external peripheral end of the third coil is connected to the external peripheral end of the second coil; and a fourth coil which is formed in a swirled shape winding in the same direction as the first coil, and which fourth coil is disposed on the vibrating diaphragm at a position overlapping the third coil in such a way that the internal peripheral portion of the swirl is situated at an area adjacent to and including a position corresponding to the external edge of the second magnetic pole surface, and the internal peripheral end of the fourth coil is connected to the internal peripheral end of the third coil.

Further, since the internal peripheral end of the first coil and the internal peripheral end of the second coil are connected to each other, the internal peripheral end of the third coil and the internal peripheral end of the fourth coil are connected to each other, and the external peripheral ends of the second coil and the third coil are connected to each other, a coil can be formed by a single line which is continuous from the beginning to the end thereof.

In accordance with the second aspect of the present invention, the first coil is disposed on one surface of the vibrating diaphragm, the second coil is disposed on the other surface of the vibrating diaphragm so that the internal peripheral end passes through the vibrating diaphragm so as to be connected to the internal peripheral end of the first coil, and the third coil is disposed on the other surface of the vibrating diaphragm and the fourth coil is disposed on the one surface of the vibrating diaphragm so that the internal peripheral end of the fourth coil passes through the vibrating diaphragm so as to be connected to the internal peripheral end of the third coil. In this way, the vibrating diaphragm can be used effectively by disposing the coils both sides of the vibrating diaphragm.

In accordance with the second aspect of the present invention, the first coil, the second coil, the third coil, and the fourth coil form one set of coil group set. The external peripheral end of the first coil and the external peripheral end of the fourth coil of the coil groups are connected to each other so that a plurality of coil groups can be disposed. Also in this case, because currents in the same direction are flown into coils of the coil groups, which are adjacent to each other and which are disposed on the same surface of the vibrating diaphragm, the conversion efficiency is increased and the occurrence of noise or the like is greatly reduced The aforementioned coil groups can be stacked in the thickness direction of the coil.

In accordance with the first and second aspects of the present invention, a pair of magnets comprising the first magnet and the second magnet, a pair of coils (in the second aspect of the present invention, from the first coil to the fourth coil) comprising the first coil and the second coil which are provided so as to correspond to the first magnet and the second magnet, respectively, and a vibrating portion of the vibrating diaphragm which corresponds to the area between the first magnet and the second magnet form one unit. Since the vibrating portion operates as an independent vibrating surface, an individual unit can operate as an independent speaker.

As a result, in accordance with the first and second aspects of the present invention, at least one of each of the first magnet and the second magnet is scattered on a predetermined face, namely, are disposed in an irregular order, which is at random, or is in accordance with a predetermined regular order. In this case, as described above, the first and second coils, or the first through fourth coils are situated so as to correspond to each of the first and second magnets which are thus disposed.

In accordance with the first and second aspects of the present invention, a plurality of rows of magnets are positioned in such a way that a row of magnets having the first magnet and the second magnet disposed alternately along a first direction intersects with a second row of magnets having the first magnet and the second magnet disposed alternately along a second direction. By disposing the magnets as described above, a plurality of the first magnets and a plurality of the second magnets can be disposed in the form of a matrix. Further, when the magnets are disposed in the form of a matrix, as described above, the first and second coil or the first to fourth coils are situated on the vibrating diaphragm so that the internal peripheral portion of each of the coils corresponds to each of the first and second magnets which have been disposed.

As described above, by disposing a plurality of the first magnets and a plurality of the second magnets in a state in which they are scattered or in the form of a matrix, a large number of magnets can be disposed as compared to when the bar magnets are disposed in parallel. Because coils equal in number to the number of magnets or to a multiple of the number of magnets can be disposed, the sum of the length of the portions of coils which link to the magnetic flux is made longer, the ratio of the surface of the vibrating diaphragm which is occupied by the coils increases, and the acoustic conversion efficiency is improved so that the sound quality can be improved.

As described above, in the state in which a plurality of the first and second magnets are scattered or in the case in which they are disposed in the form of a matrix, the first coil L1 and the second coil L2 are connected to each other as described in FIGS. 2 and 3. Namely, when the winding directions from the external periphery to the internal periphery of the first and second coils are the same, as shown in FIG. 2A (or FIG. 2B), the internal peripheral ends (or the external peripheral ends) of the first coil L1 and the second coil L2 adjacent to each other are connected to each other, and the external peripheral ends (or the internal peripheral ends) of the first coil L2 and the second coil L1 adjacent to each other are connected to each other. Thus, a plurality of coils are connected to each other.

When the winding directions from the external periphery to the internal periphery of the first and second coils are different from each other and the first and second coils are arranged alternately, as shown in FIG. 3A (or FIG. 3B), the internal peripheral end (or the external peripheral end) of the first coil L1 is connected to the external peripheral end (or the internal peripheral end) of the second coil L2 which is adjacent to the first coil L1. The internal peripheral end (or the external peripheral end) of the second coil L2 is connected to the external peripheral end (or the internal peripheral end) of the first coil L1 adjacent to the second coil L2 and thus a plurality of coils are connected to each other. Moreover, as shown in FIG. 3C, the internal peripheral ends and the external peripheral ends of the first coil L1 and the second coil L2 can be connected to each other.

Further, in the state in which a plurality of the first magnets and a plurality of the second magnets are scattered, or in the case in which they are disposed in the form of a matrix, as shown in FIGS. 2 and 3, a coil group which is formed by the first coil and the second coil which are connected to each other in series is equal to one unit. As shown in FIG. 3C, these coil groups can be connected to each other in parallel.

As described above, the impedance of a flat speaker can be set to an appropriate value by connecting a plurality of coils to each other in series or in parallel or by mixing in-series connections with in-parallel connections. Further, in this way, since coils can be connected freely, it becomes possible to form a coil group with one coil or by connecting a plurality of coils. For this reason, by disposing a plurality of coil groups inside the flat speaker and connecting individual sound sources to each of the coil groups, a multichannel sound source or a stereophonic source can be provided through a single flat speaker. A single signal source may also be connected to all of the coil groups.

The above-described first and second magnets can be provided on a plate member which is formed from a magnetic material. By disposing the magnets as described above, the area between the first magnet and the second magnet on the plate member can operate as a magnetic path. Because the magnetic flux only passes inside the magnetic path, and does not leak to the outside of the magnetic path, a high density magnetic flux can be generated at the sides of the first and second magnetic pole surfaces so that sound signals having a large amount of volume can be output.

Moreover, when a second plate member which is formed by a magnetic material is disposed on the opposite side of the aforementioned plate member with a vibrating diaphragm interposed therebetween, magnetic flux passes through the inside portion of the second plate member, and can be prevented from leaking to the outside.

At least one of the first magnet and the second magnet can be formed into a plurality of configurations. In this case, the first coil and the second coil can be formed into a winding shape so as to be analogous to the shape of each of the first magnet and the second magnet. By forming these magnets into multiple configurations, it is possible to dispose the first magnet and the second magnet in accordance with the configuration of a flat acoustic converting device. Accordingly, these magnets can be applied to any configuration of the flat acoustic converting device. As a result, it is possible to increase the degree of freedom in designing the whole acoustic converting device.

The above-described magnets and coils can be arbitrarily formed into a triangular, pentagon, hexagon, polygon, circular, elliptical, unfixed shape or the like other than a rectangular shape. Further, as described above, these magnets can be disposed in a state in which they are scattered on a predetermined face or they are disposed in the form of a matrix. For example, coils having a plurality of configurations may be mixed with each other and arranged at random. And as shown in FIG. 4, swirled coils L can be disposed on the surface of the vibrating diaphragm so as to be perpendicular to the magnetic flux whose orientation is along the direction between the respective magnets, and along the surface of the vibrating diaphragm. Accordingly, the entire configuration of an acoustic converting device can be designed freely. And it is possible to form acoustic converting devices having configurations which are different from the devices in the prior art. The setting of impedance can also be carried out more flexibly. Moreover, as shown in FIG. 10, magnets m and coils which are formed into triangular, circular, rectangular, and other pentagon configurations can be disposed in a fixed way.

By the combination of such configurations and layouts of coils and magnets as described above, it is possible to increase the area of the surface of the vibrating diaphragm which is occupied by the coils which wind around the respective magnets by disposing multiple magnets having a small magnetic pole surface, as compared to the case in which a plurality of the bar magnets are disposed in parallel. And it is possible to increase and make uniform the driving force which is driven to the vibrating diaphragm as compared to the case in which the bar magnets are used. For this reason, the conversion efficiency from electrical signals to sound signals thereby increases and the quality of sound can be improved.

In the present invention, the vibrating diaphragm vibrates due to the force that the current which is supplied into coils receives from the magnetic field. However, when the area of the surface of the vibrating diaphragm on which the same coil groups are situated does not vibrate as a whole, a large amount of volume cannot be output, sound may be distorted, or noise may be produced. Therefore, it is necessary to increase the hardness of the area of the vibrating diaphragm on which coils are disposed. On the other hand, the whole of the vibrating diaphragm must vibrate freely in the direction perpendicular to the surface of the vibrating diaphragm. Accordingly, it is necessary to reduce the hardness of the area of the surface of the vibrating diaphragm which surrounds the coil situating area to facilitate the displacement of the coil situating area on the vibrating diaphragm in the direction perpendicular to the surface of the vibrating diaphragm. Therefore, in the present invention, it is preferable to make the hardness of the coil situating area of the vibrating diaphragm on which area the first coil and the second coil are disposed higher than the hardness of the remaining area of the vibrating diaphragm which surrounds the coil situating area. As a result, the hardness of the area of the vibrating diaphragm which supports the coil situating area is reduced, and the vibrating diaphragm can vibrate more effectively.

The structure of the vibrating diaphragm in which a coil situating area whose hardness is made higher than the area which surrounds the coil situating area can be obtained by coating the coil situating area in order to enhance the hardness of the coil situating area, or by fixing the vibrating diaphragm on which coils are situated to another vibrating diaphragm material whose hardness is lower than this vibrating diaphragm.

In accordance with the present invention, as shown in FIGS. 5A and 5B, if magnets m, which are situated adjacent to each other, are disposed so that the polarities thereof are different from each other, because the magnetic flux between the magnets adjacent to each other is oriented from an N pole to two S poles, the magnetic flux of the area between the magnets is directed substantially in parallel with the surface of the vibrating diaphragm. However, even when the polarities of the magnets adjacent to each other are the same, or the polarities of the magnets adjacent to each other are different, as shown in FIG. 6, if the magnetic pole surfaces whose polarities are partially the same are disposed so as to be adjacent to each other, places at which the orientation of the magnet flux reverses are formed at the intermediate portion of each of the N polarities. For this reason, it is necessary to design positions at which the direction in which currents are supplied into coils may reverse with high accuracy, which is not practical. Further, as shown in FIG. 7, if an odd number of triangular magnets m are provided in a circle, a group of magnets whose polarities are the same may be formed adjacent to each other. In this case, the orientation of the magnetic flux between two magnets whose polarities are the same is reversed, ant is therefore not practical. Therefore, as shown in FIGS. 5A and 5B, it is preferable that the magnets adjacent to each other are disposed so as to be positioned in alignment with each other.

The third aspect of the present invention is a flat acoustic converting device, comprising: a magnet which has a first magnetic pole surface on one surface of the magnet and has a second magnetic pole surface whose polarity is different from the polarity of the first magnetic pole surface on the other surface thereof; a first vibrating diaphragm which is disposed so as to correspond to the first magnetic pole surface of the magnet; a second vibrating diaphragm which is disposed so as to correspond to the second magnetic pole surface of the magnet; a first coil which is formed in a swirled shape, and which is disposed on the vibrating diaphragm at a position where the internal peripheral portion of the swirl is situated at an area adjacent to and including a position corresponding to the external edge of the first magnetic pole surface; and a second coil which is formed in a swirled shape, and which is disposed on the vibrating diaphragm at a position where the internal peripheral portion of the swirl is situated at an area adjacent to and including a position corresponding to the external edge of the second magnetic pole surface.

The present invention is structured as one magnet and two vibrating diaphragms and is provided so as to output sound signals from the two vibrating diaphragms at the same time.

As described above, in accordance with the present invention, the first magnet and the second magnet are disposed on a predetermined face so as to be adjacent to each other so that the magnetic pole surfaces thereof whose polarities are different from each other are oriented in the same direction. Accordingly, the orientation of the magnetic flux between the first magnet and the second magnet is substantially in parallel with the surface of the vibrating diaphragm. Further, each of the first and second coils is disposed so that the internal periphery of each coil is situated on the vibrating diaphragm at the area which includes the position which corresponds to the external edge of the magnetic pole surface, and is adjacent to the position which corresponds to the external edge of the magnetic pole surface. Accordingly, the magnetic flux whose orientation is substantially in parallel with the surface of the vibrating diaphragm is linked to both the first coil and the second coil. When a current is supplied into the first coil and the second coil, the direction of the force that the current receives from the magnetic field is substantially perpendicular to the surface of the vibrating diaphragm, and the force which is applied along the direction of the surface of the vibrating diaphragm extraordinarily decreases. As a result, an excellent effect can be obtained in that noise components are reduced and the quality of sound can be improved.

Further, by disposing a plurality of the first magnets and a plurality of the second magnets in a state in which they are scattered or in the form of a matrix, a large number of magnets can be disposed as compared to the case in which the bar magnets are disposed in parallel. Because coils which are equal in number to the number of magnets or a multiple of the number of magnets can be disposed, the sum of the length of the portions of coils which link to the magnetic flux is made longer, the ratio of the surface of the vibrating diaphragm which is occupied by the coils increases, and the acoustic conversion efficiency is improved so that the sound quality can be improved.

The first magnet and the second magnet can be disposed in accordance with the configuration of a flat speaker by forming at least one of the first magnet and the second magnet into multiple configurations. Accordingly, these magnets can be applied to a flat speaker having an arbitrary configuration. As a result, the effect of an increase in the freedom in designing the entire configuration of the flat speaker is obtained.

PREFERRED EMBODIMENTS OF THE PRESENT INVENTION

With reference to the drawings, a detailed description of an embodiment of the present invention which is applied to a speaker will be given hereinafter.

Figure 1:
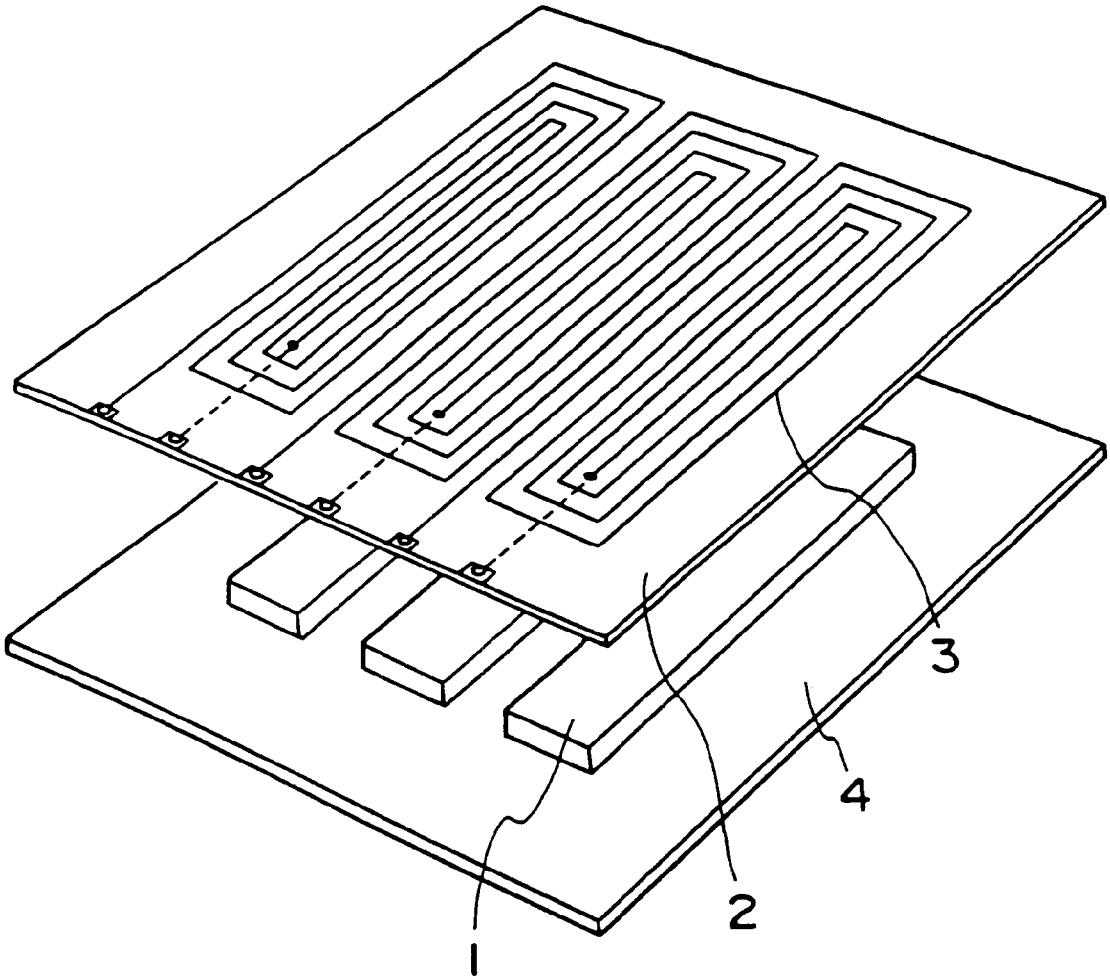
FIG. 1 (PRIOR ART)
FIG. 1 is an exploded perspective view illustrating a conventional flat speaker.
Figure 2A:
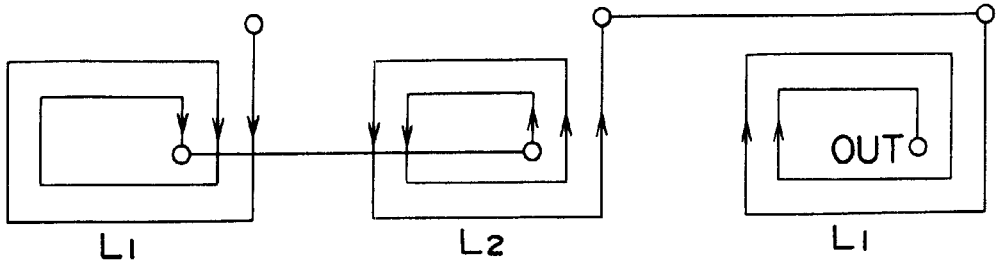
FIG. 2A is an explanatory view which illustrates an example of a connected state of the first coil and the second coil relating to the present invention when the coils are wound in the same direction from the external periphery to the internal periphery of each coil.
Figure 2B:
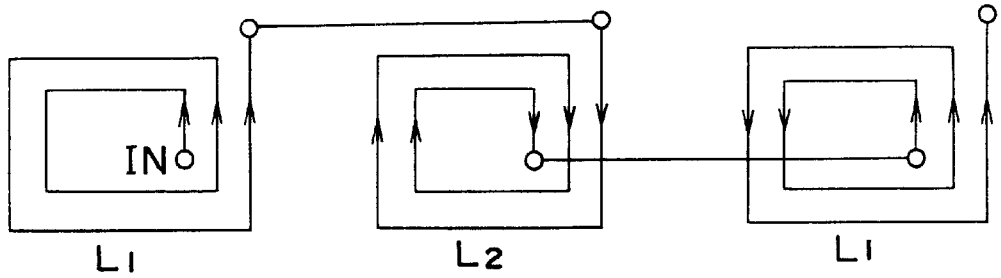
FIG. 2B is an explanatory view relating to the present invention which illustrates another example of a connected state of the first coil and the second coil relating to the present invention when the coils are wound in the same direction from the external periphery to the internal periphery of each coil.
Figure 3A:
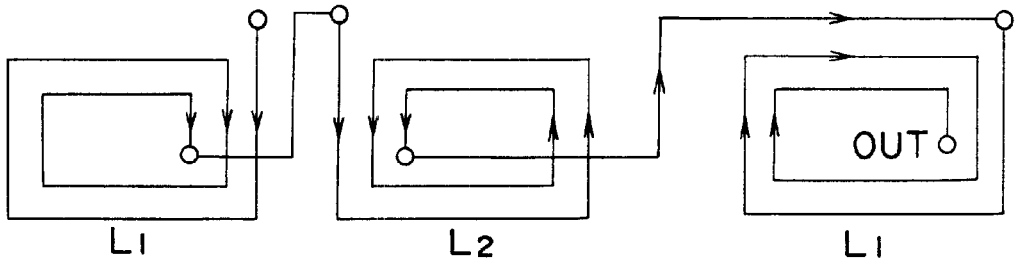
FIG. 3A is an explanatory view illustrating an example of a connected state of the first coil and the second coil relating to the present invention when the coils are wound in different directions from the external periphery to the internal periphery of each coil
Figure 3B:
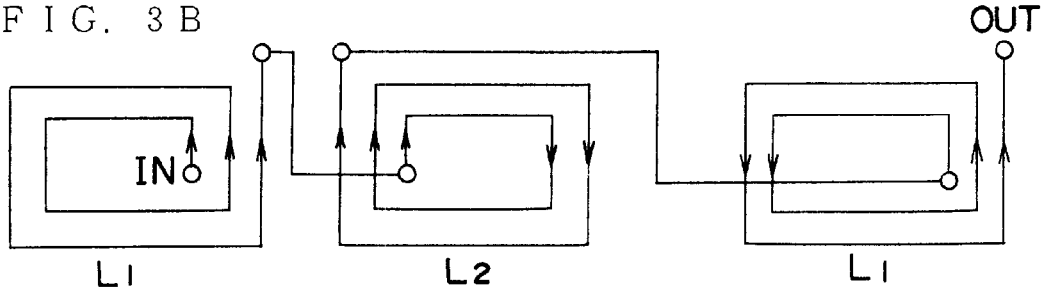
FIG. 3B is an explanatory view illustrating another example of a connected state of the first coil and the second coil relating to the present invention when the coils are wound in different directions from the external periphery to the internal periphery of each coil.
Figure 3C:
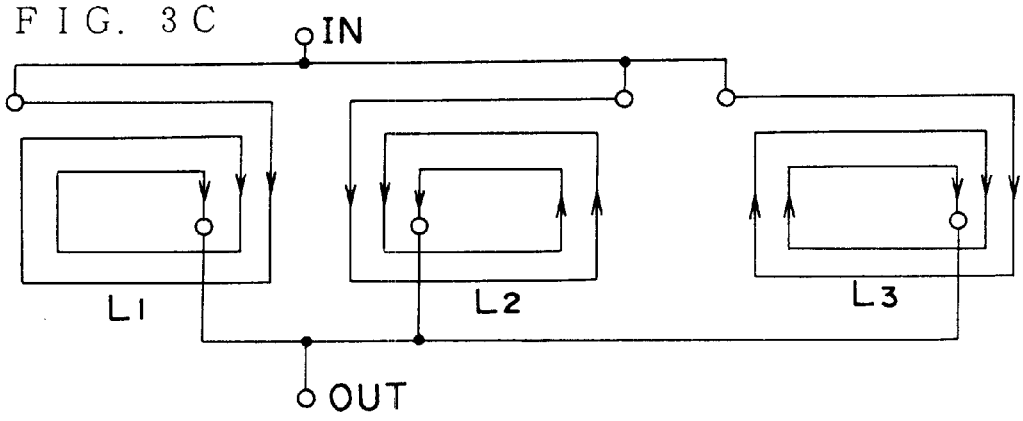
FIG. 3C is an explanatory view illustrating yet another example of a connected state of the first coil and the second coil relating to the present invention when the coils are wound in different directions from the external periphery to the internal periphery of each coil.
Figure 4:
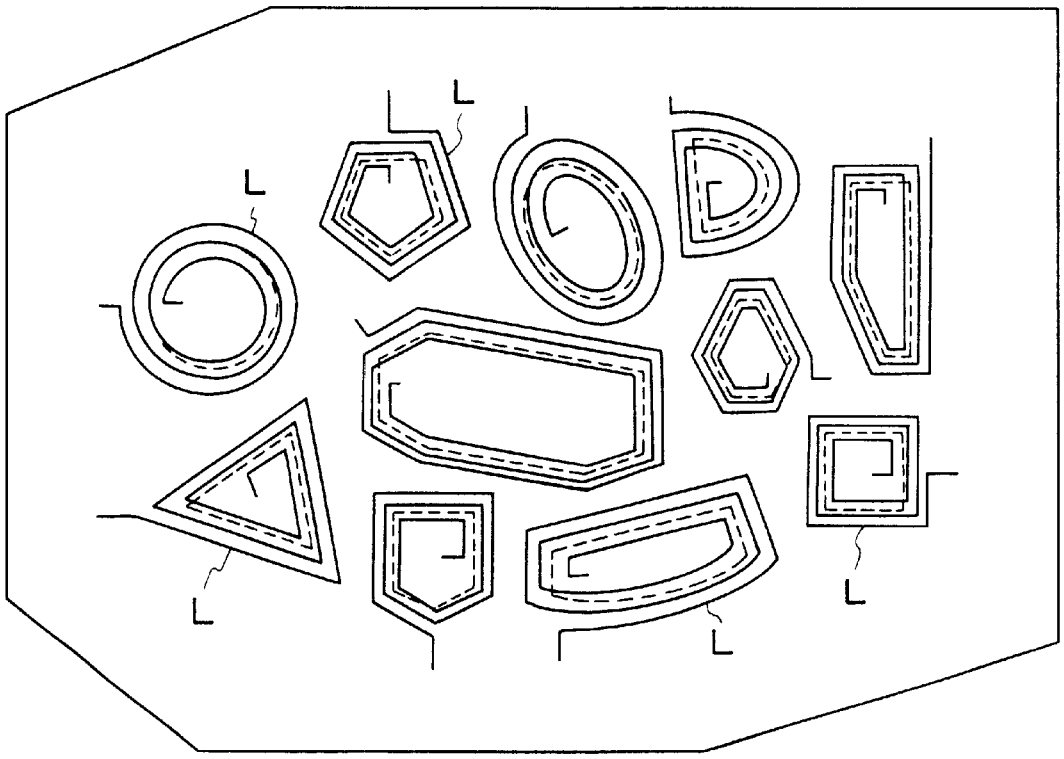
FIG. 4 is a plan view illustrating the coils relating to the present invention when they are arranged in a state in which the magnets are scattered.
Figure 5A:
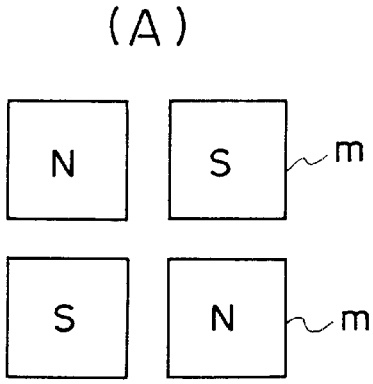
FIG. 5A is a plan view illustrating an example of the magnets relating to the present invention when the magnets adjacent to each other are positioned in alignment with each other.
Figure 5B:
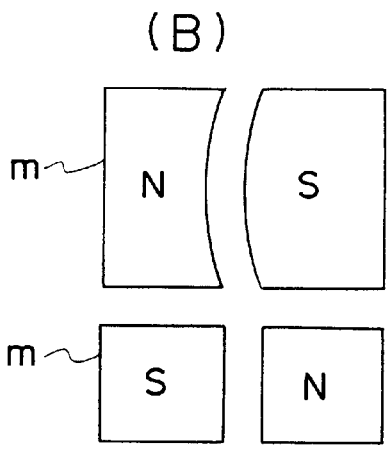
FIG. 5B is a plan view illustrating another example of a positioning state of the magnets relating to the present invention when the magnets adjacent to each other are positioned in alignment with each other.
Figure 6:
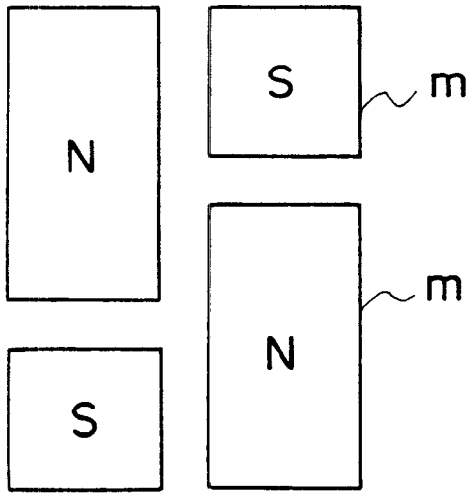
FIG. 6 is a plan view illustrating the magnets relating to the present invention when the magnets adjacent to each other are displaced from each other.
Figure 7:
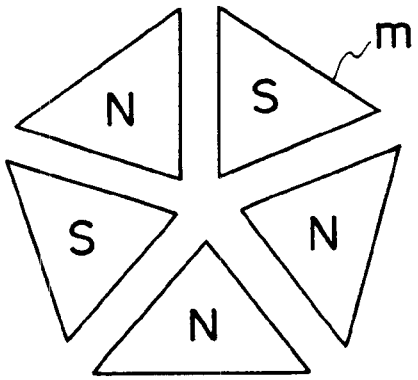
FIG. 7 is a plan view illustrating a state when an odd number of magnets are arranged in a circle.
Figure 8:
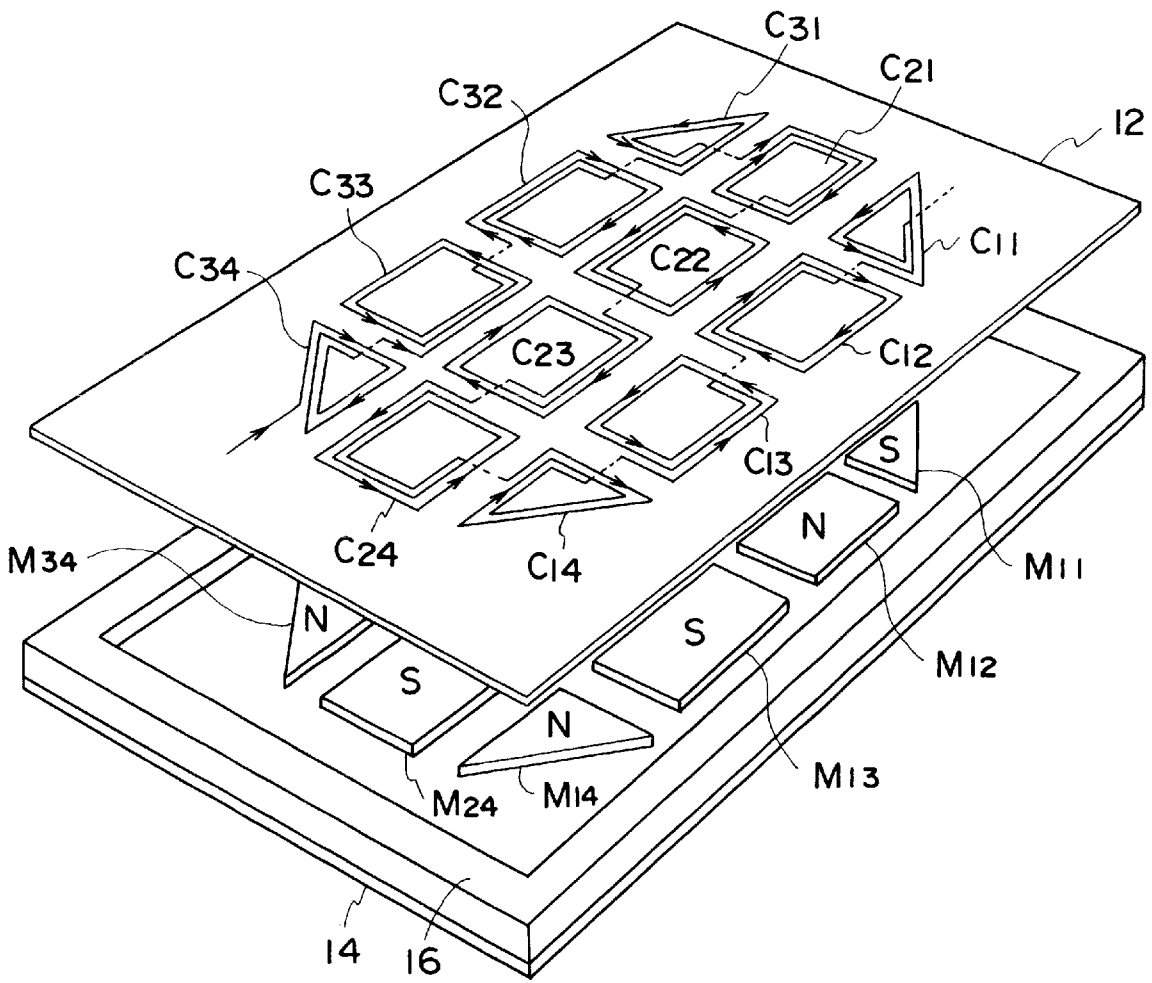
FIG. 8 is an exploded perspective view illustrating a first embodiment of the present invention.

As shown in FIG. 8, a flat speaker unit relating to the first embodiment has a yoke 14 which is comprised of a rectangular plate member formed from a magnetic material. A flat and triangular permanent magnet M11 is fixed to a corner of the top surface of the yoke 14 by an adhesive. The permanent magnet M11 is disposed with the oblique line of the triangular configuration thereof facing the corner portion of the yoke 14 so that the S magnetic pole surface faces upwardly. Ferrite magnet can be used for the permanent magnets.

A flat and rectangular permanent magnet M12 is disposed at a position which is adjacent to the permanent magnet M11 along the lengthwise direction of the yoke 14 so as to be apart from the permanent magnet M11 by a predetermined distance. The permanent magnet M12 is disposed with the N magnetic pole surface thereof facing upwardly, and one of the sides of the permanent magnet M12 is disposed in parallel with the base of the permanent magnet M11.

A flat and rectangular permanent magnet M13 is provided at a position which is adjacent to the permanent magnet M12 along the lengthwise direction of the yoke 14 in a state in which the S magnetic pole surface of the permanent magnet M13 faces upwardly. A flat and triangular permanent magnet M14 is provided at a position which is adjacent to the permanent magnet M13 along the lengthwise direction of the yoke 14 with the N magnetic pole surface thereof facing upwardly.

Further, three permanent magnets are provided so as to be adjacent to each other and be spaced apart from each other along the widthwise direction of each of M11, M12, M13 and M14, respectively, so that the magnetic pole surfaces whose polarities are different from each other are disposed alternately. Because each of the permanent magnets M11 to M34 is flat, and the top and rear surfaces thereof are in parallel with each other, each of the magnetic pole surfaces of the permanent magnets M11 to M34 is disposed in parallel with the top surface of the yoke 14 so as to face in the same direction.

As a result, twelve permanent magnets which are formed by mixing triangular configurations and rectangular configurations are disposed in the form of a matrix in which each of the triangular permanent magnets is located at the four corner portions and the polarities of the permanent magnets adjacent to each other are different from each other. In this way, because the permanent magnets are disposed so that the polarities of the permanent magnets adjacent to each other are different from each other, the magnetic flux between the respective permanent magnets adjacent to each other are directed substantially in parallel with the top surface of the yoke.

When a permanent magnet Mij (wherein in the case of i=1 or 3, then j=1 or 3, and in the case of i=2, then j=2 or 4), whose magnetic pole surface facing upwardly has a first polarity, corresponds to one of the first magnet and the second magnet of the present invention, the permanent magnet Mij (wherein in the case of i=1 or 3, then j=2 or 4, and in the case of i=2, then j=1 or 3), whose magnetic pole surface facing upwardly has a second polarity, corresponds to the other of the first magnet and the second magnet of the present invention. A magnet row is formed by a plurality of magnets along a side of the yoke, which have the magnetic pole surfaces whose polarities are different from each other, disposed alternately so as to face upwardly. Namely, a plurality of magnets row are disposed in parallel so that the magnetic pole surfaces whose polarities are different from each other are disposed alternately along another side of the yoke.

A spacer 16 which is frame shaped and is thicker than the permanent magnets is disposed on the top surface of the yoke 14 so that all of the permanent magnets are situated inside the opening of the spacer 16.

The peripheral portion of the surface of the vibrating diaphragm 12 is fixed to the top surface of the spacer 16. Namely, the vibrating diaphragm 12 is disposed so as to be in parallel with the magnetic pole surfaces of the permanent magnets, i.e., the top surface of the yoke. A predetermined tensional force is applied to the surface of the vibrating diaphragm 12. Accordingly, the surface of the vibrating diaphragm 12 is disposed so as to be adjacent to, and facing the magnetic pole surfaces of the permanent magnets. The vibrating diaphragm 12 is formed by a high polymer film which is made of polyimide, polyethylene terephthalate or the like. An octagonal coil situating area whose hardness has been increased by coating ceramics thereon is disposed at the central portion of the vibrating diaphragm 12. Accordingly, the hardness of the portion surrounding the coil situating area on the vibrating diaphragm 12 is made lower than the coil situating area. The vibrating diaphragm 12 is fixed to the top surface of the spacer 16 at the portion surrounding the coil situating area whose hardness is low.

Coils C11 to C34, each of which is wound so as to form a swirled shape, and corresponds to the permanent magnets M11 to M34, respectively, are disposed on the top surface of the coil situating area on the vibrating diaphragm 12. Each of the coils C11 to C34 is formed so that it is substantially analogous to the external edge of each of the permanent magnets M11 to M34, and the coil which corresponds to the magnetic pole surface having the same polarity is wound in the same direction from the external peripheral portion to the internal peripheral portion thereof.

The coils C11, C14, C31 and C34 which correspond to the triangular permanent magnets, respectively are wound so as to form a triangular shape. The coils C12, C13, C21 to 24, C32 and C33 which correspond to the rectangular permanent magnets, respectively are wound so as form a rectangular shape.

This type of coil is made into a voice coil by depositing a thin copper film on the coil situating area of the vibrating diaphragm 12, and etching the thin copper film to form a swirled shape in a plane. Each coil is coated with an insulating material.

Figure 9:
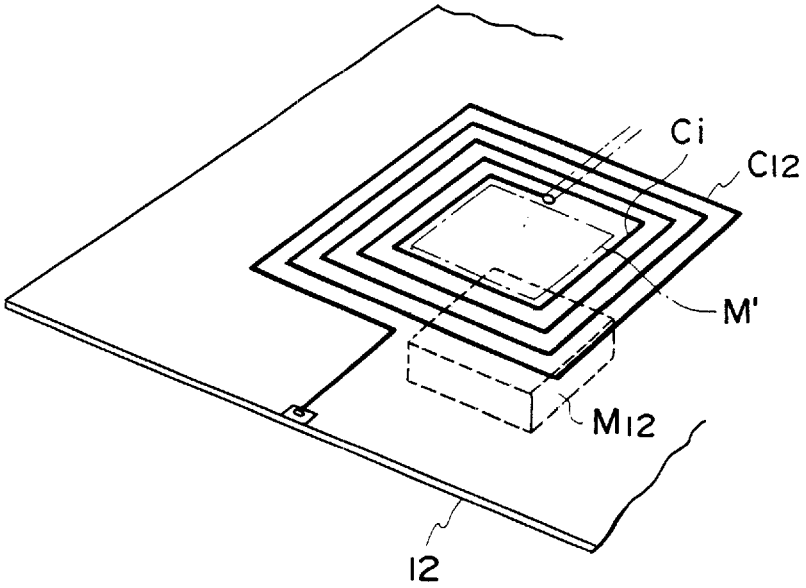
FIG. 9 is a partial perspective view illustrating a swirled coil which is disposed outside a position which corresponds to the external edge of each of the permanent magnets on a vibrating diaphragm relating to the aforementioned first embodiment.
Figure 10:
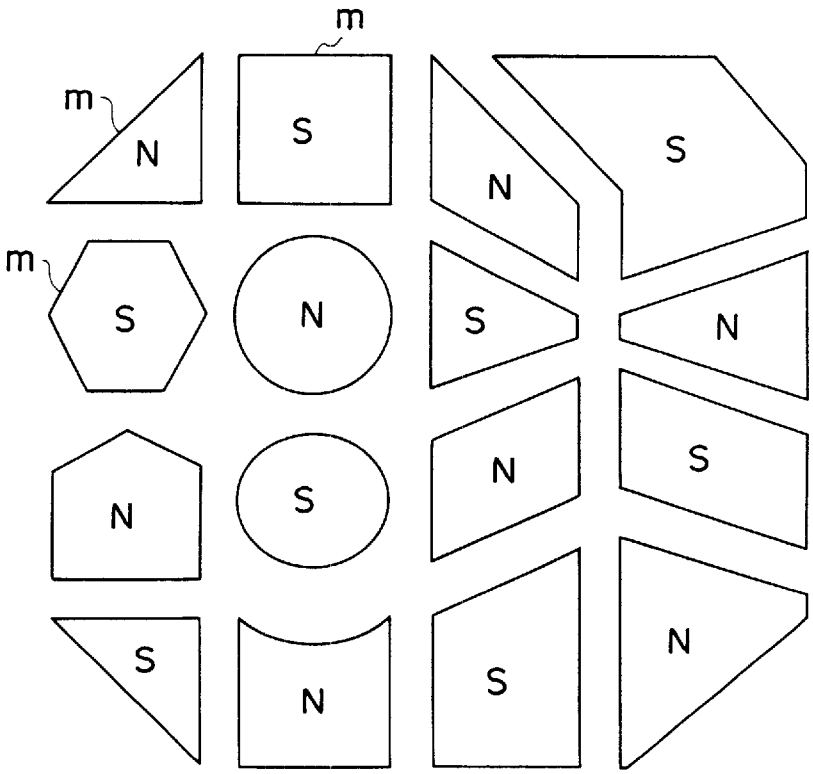
FIG. 10 is a plan view illustrating a state where the magnets are positioned so that the polarities of the magnetic polar surfaces of the permanent magnets adjacent to each other are different from each other.

Further, as shown in FIG. 9, the coil C12 is situated at an area outside a position M' on the vibrating diaphragm 12, at which the internal periphery Ci of the coil corresponds to the external edge of the magnetic pole surface, and as shown in FIG. 8, the coils are situated on the vibrating diaphragm 12 so that the external peripheral portions of the swirls, i.e., the external peripheral portions of the coils do not overlap each other. In the same manner as the coil C12, the other coils are disposed on the vibrating diaphragm 12 so that the internal periphery of each coil is situated on the vibrating diaphragm in an area outside a position which corresponds to the external edge of the magnetic pole surface so that the external peripheral portions of the coils do not overlap. In this way, each of the coils C11 to C34 is positioned on the vibrating diaphragm so as to surround the position M' which corresponds to each of the magnetic pole surfaces.

Then, the external peripheral end and the internal peripheral end of each of the coils adjacent to each other in the direction of a row of permanent magnets are connected to each other. Accordingly, a coil row of the coils C34 to C31 which are connected to each other in series in a sequential order, a coil row of the coils C21 to C24 which are connected to each other in series in a sequential order, and a coil row of the coils C14 to C11 which are connected to each other in series in a sequential order are thereby formed. These rows of coils are sequentially connected to each other in series.

The aforementioned yoke 14 on which a number of permanent magnets are fixed, and the spacer 16 to which the vibrating diaphragm 12 having a number of coils formed thereon is fixed are assembled as a flat speaker unit by the peripheral edge thereof being supported by an unillustrated supporting member.

In this way, since coils are disposed on the vibrating diaphragm which is disposed so as to be close to and be parallel to the magnet pole surfaces of the permanent magnets in such a manner as described above, the magnet flux acts upon the adjacent portions of the respective coils along the surface of the vibrating diaphragm. Accordingly, when a current is supplied from one end to the other of each of the coil groups which are connected to each other in series on the flat speaker unit, the current running in the same direction is supplied into the adjacent portions of the coils adjacent to each other. The current which is supplied to the portions adjacent to each other of the coils adjacent to each other receives from the magnetic field a force applying in the same direction perpendicular to the surface of the vibrating diaphragm. As a result, because the vibrating diaphragm hardly receives any of the force along the surface of the vibrating diaphragm, and vibrates in the direction perpendicular to the surface of the diaphragm, the amount of noise components is greatly reduced so that the quality of sound can be improved. Moreover, in the aforementioned embodiment, because the coil situating area is coated by ceramics, the ceramic coated coil situating area vibrates integrally with the vibrating diaphragm, and sound is not distorted, and a large amount of volume can be outputted.

In the present embodiment, a plurality of permanent magnets are disposed in the lengthwise direction of the conventional bar magnets, i.e., in the direction of the rows of magnets according to the present embodiment, and a plurality of coils are disposed on the vibrating diaphragm so as to surround each of the positions which correspond to the permanent magnets. Accordingly, the total length of the external edges of the plurality of permanent magnets is made longer than that of the external edges of the bar magnets. Therefore, the total length of the coil portions which link to the magnetic flux is made longer than in the case in which the bar magnets are used. Therefore, it is possible to increase the ratio of the area of the surface of the vibrating diaphragm which is occupied by the coils which surround the respective permanent magnets as compared to the case in which a plurality of the bar magnets are provided in parallel. And the effective magnetic flux can be increased as compared to the prior art. As a result, the conversion efficiency from an electrical signal to a sound signal can be improved, and the quality of sound can be improved.

Because the permanent magnets and coils which are formed into various configurations such as triangles and rectangles have been mixed and situated as permanent magnets and coils, it is possible to form the speaker into a configuration which is different from a conventional speaker.

Next, a second embodiment of the present invention will be explained with reference to FIG. 11. The device according to the second embodiment is formed by a magnetic material and has a yoke 20 which is formed by a rectangular plate member on which multiple punched holes 20A (4×9=36 in the present embodiment) are formed in the form of a matrix. In this way, a magnet fixing portion for fixing permanent magnets to the yoke 20 is formed at a position which is surrounded by the four adjacent holes 20A.

Permanent magnets m11 to m38 each of which is formed in a flat and rectangular shape are fixed and situated at each of the magnet fixing portions through adhesion so that the magnetic pole surfaces whose polarities are different from each other are positioned alternately so as to face upwardly. Namely, a permanent magnet mij (when i=1 or 3, then j=1, 3, 5, or 7, and when i=2, then j=2, 4, 6, or 8) is fixed so that the S polar magnetic pole surface faces upwardly. A permanent magnet mij (when i=1 or 3, then j=2, 4, 6, or 8, and when i=2, then j=1, 3, 5, or 7) is fixed to the yoke 20 so that the N magnetic pole surface faces upwardly. In addition, it is possible to fix each of these magnetic pole surfaces with the S and N poles thereof reversed.

A vibrating diaphragm 26 is disposed on the top surface of the yoke 20 so as to be close to the magnetic pole surfaces so that the vibrating diaphragm 26 is disposed so as to be in parallel with the magnetic pole surfaces of the permanent magnets, and accordingly, with the top surface of the yoke 20. In the same manner as the first embodiment, the vibrating diaphragm 26 is formed from a high polymer film such as polyimide, polyethylene terephthalate or the like. A rectangular coil situating area whose hardness is increased by coating ceramics thereon is disposed at the central portion of the vibrating diaphragm 26. Accordingly, the entire peripheral area of the surface of the vibrating diaphragm 26 which surrounds the coil situating area has a hardness which is lower than the coil situating area. Moreover, the vibrating diaphragm is formed by a diaphragm which is made of a high polymer film such as polyimide, polyethylene terephthalate or the like and whose hardness is fixed. A number of punched holes are formed along the external edge around the coil situating area. Accordingly, the hardness of the area of the surface of the vibrating diaphragm 26 which surrounds the coil situating area may be made lower than the coil situating area.

The vibrating diaphragm 26 is fixed to a frame body 24 by fixing the entire peripheral edge of the vibrating diaphragm 26 whose hardness is low to the frame body 24. The frame body 24 has an opening which is large enough for accommodating therein all of the permanent magnets which are fixed to the yoke.

Pairs of coils L11 to L38 are disposed on the coil situating area of the vibrating diaphragm 12 so as to correspond to the permanent magnets m11 to m38, respectively. Each pair of coils L11 to L38 is formed in a swirled shape and is disposed on both surfaces of the coil situating area so as to correspond to each of permanent magnets m11 to m38. Further, each pair of coils L11 to L38 is wound so as to form a swirled shape and be substantially analogous to the external edge of the magnetic pole surface of each of the permanent magnets m11 to m38. The internal periphery of each coil, i.e., the internal periphery of the swirl is situated on the vibrating diaphragm in the area of the magnetic pole surface outside the position which corresponds to the external edge of the magnetic pole surface so that the external peripheral ends of the coils do not overlap each other.

In the same manner as the first embodiment of the present invention, the coil according to the present embodiment is structured by depositing a thin, copper film on the coil situating area of the vibrating diaphragm 26 and by etching this thin, copper film so that the plane configuration thereof is formed into a swirled shape. And each coil is coated by an insulating material.

A damper 22, which is made from a soft material such as a non-woven fabric, a sponge, a glass wool, a foaming urethane, or the like, is interposed between the vibrating diaphragm 26 and the plurality of magnetic pole surfaces in order to prevent the coils and the magnetic pole surfaces from coming in contact with each other due to the vibration of the vibrating diaphragm.

In the same manner as the yoke 20, a magnetic shield member 28 is disposed above the top surface of the vibrating diaphragm 26. The magnetic shield member 28 is made from a rectangular plate member which is formed from a magnetic material and on which a number of punched holes 28A are formed in the form of a matrix (in the present embodiment, 4×9=36 holes).

Figure 12:
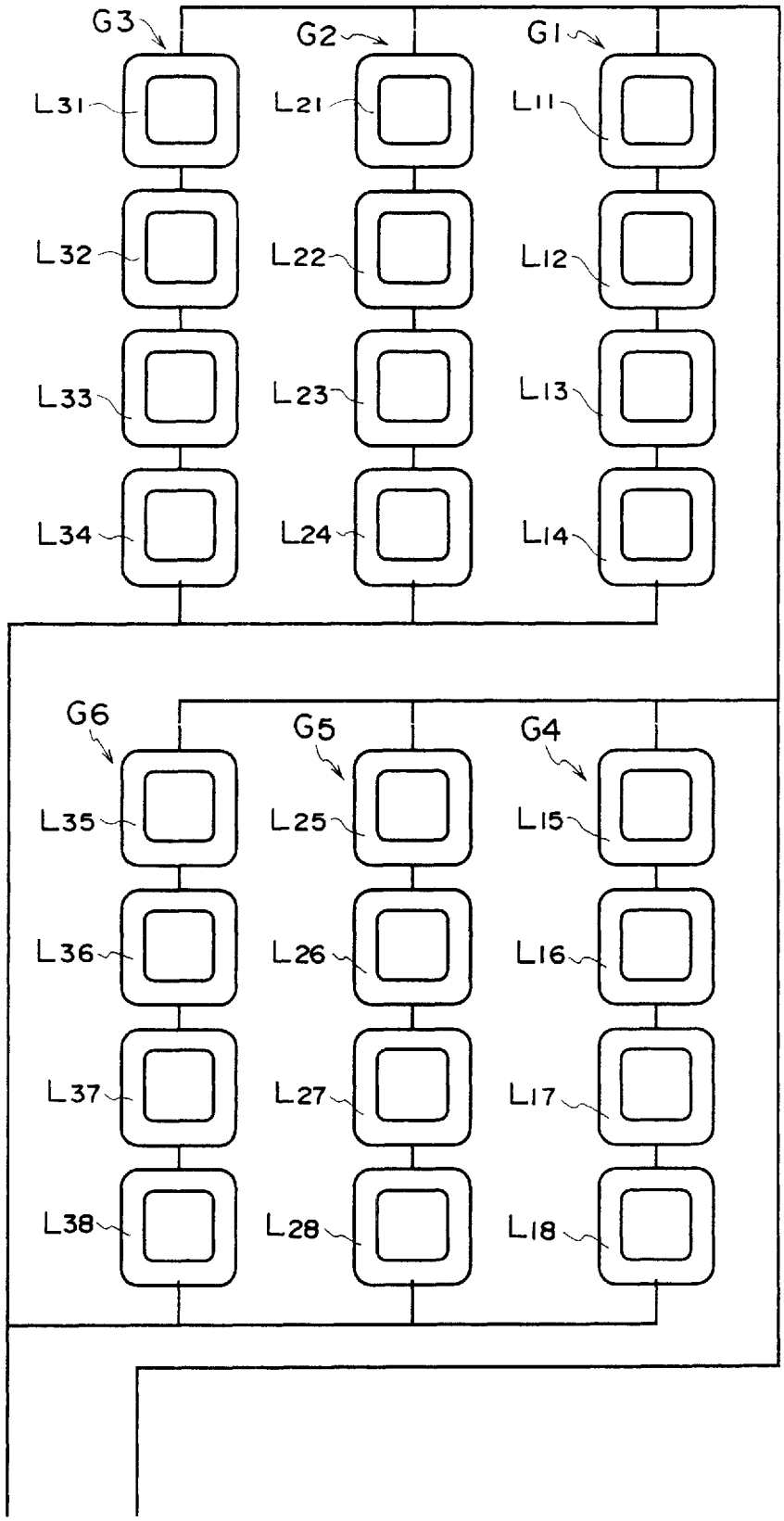
FIG. 12 is a plan view relating to the second embodiment of the present invention illustrating a state where the coils are connected.

As shown in FIG. 12, a plurality of pairs of coils (in the present embodiment, 4 pairs) among the pairs of coils L11 through L38 are connected to each other in series so as to form a plurality of coil groups G1 through G6 (in the present embodiment, 6 groups). These coil groups G1 through G6 are connected to each other in parallel.

Figure 13:
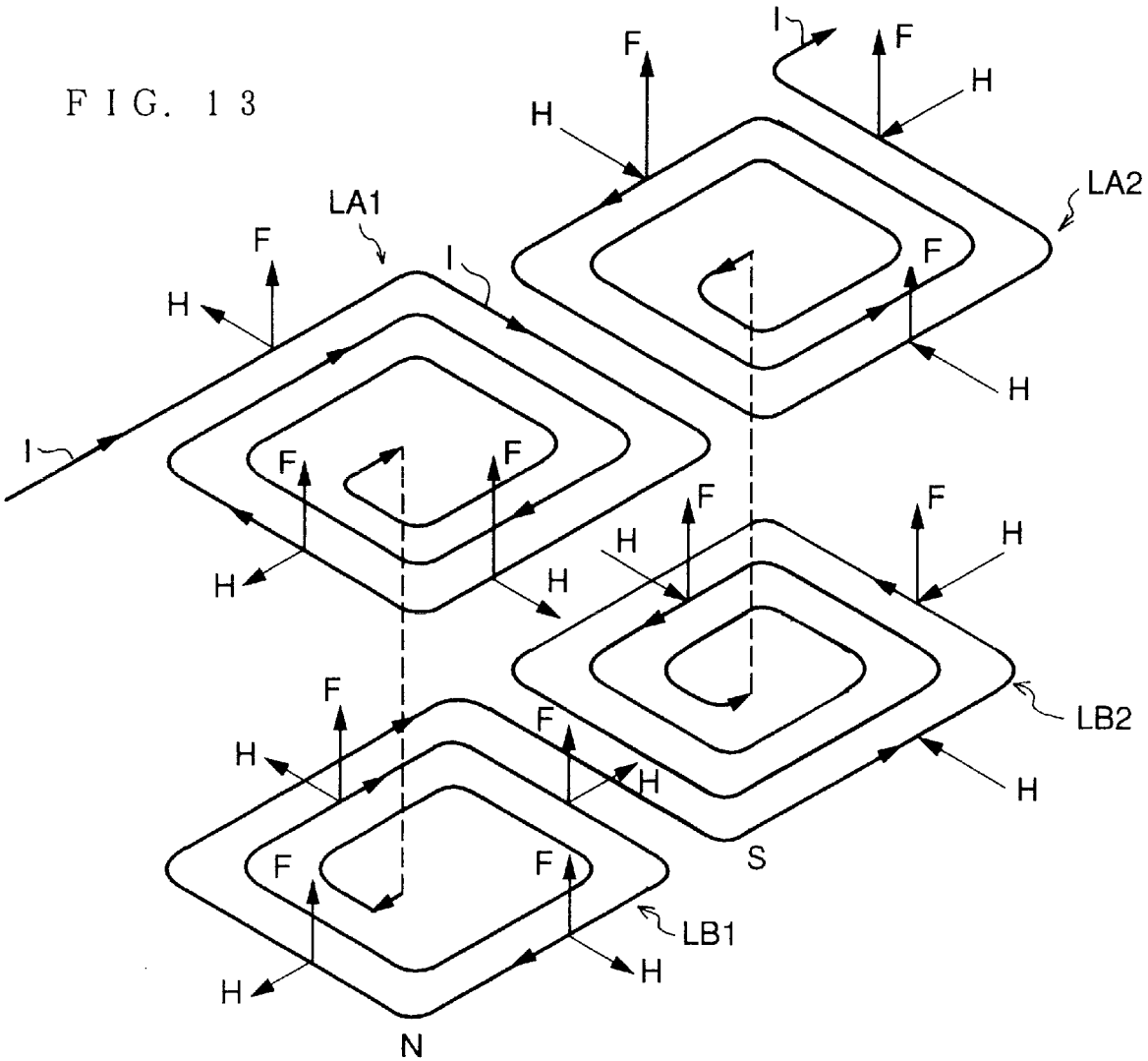
FIG. 13 is an explanatory view according to the second embodiment of the present invention illustrating a state where the coils are positioned on the top and rear surfaces of the vibrating diaphragm.

With reference to FIG. 13, a description of the winding direction and the connected state of the coil groups G1 through G6 will be given hereinafter. Further, since the winding direction and the connected state of each pair of coils are almost the same, a description of a pair of coils which are adjacent to each other in a lengthwise direction of the vibrating diaphragm and are connected in series will be given hereinafter. Therefore, descriptions of the winding directions and the connected states of other pairs of coils will be omitted. Moreover, a description will be given by referring to the coil of the pair of coils which is situated on the top surface of the coil situating area (which corresponds to the first coil of the second invention) as LA1, and by referring to the other coil of the pair of the coils which is situated on the rear surface of the coil situating area (which corresponds to the second coil of the second invention) as LB1. The coil of another pair of coils, which is situated on the top surface of the coil situating area (which corresponds to the fourth coil of the second invention) is referred to as LA2, and the other coil of the other pair of the coils, which is situated on the rear surface of the coil situating area (which corresponds to the third coil of the second invention) is referred to as LB2. In addition, all of the winding directions of respective coils are oriented as seen from the top surface of the vibrating diaphragm.

The coil LA1 is wound from the external periphery to the internal periphery thereof in a clockwise direction, the coil LB1 is wound from the internal periphery to the external periphery in a clockwise direction, the coil LB2 is wound from the external periphery to the internal periphery thereof in a counterclockwise direction, and the coil LA2 is wound from the internal periphery to the external periphery thereof in a counterclockwise direction. Accordingly, the coils which are disposed on a surface of the coil situating area are wound from the internal periphery to the external periphery (or else from the external periphery to the internal periphery) of the coil in the same direction.

The internal peripheral end of the coil LA1 passes through the coil situating area of the vibrating diaphragm 26 vertically from the top surface to the rear surface thereof and is connected to the internal peripheral end of the coil LB1. The external peripheral end of the coil LB1 extends along the rear surface of the coil situating area and is connected to the external peripheral end of the coil LB2. The internal peripheral end of the coil LB2 passes through the coil situating area of the vibrating diaphragm 26 vertically from the top surface to the rear surface thereof and is connected to the internal peripheral end of the coil LA2. The external peripheral end of the coil LA2 extends along the top surface of the coil situating area and is connected to the external peripheral end of the coil which is adjacent to the coil LA2.

In addition, the coils within each coil group are connected to each other in series by repeating the winding direction and the connected state which have been described above.

When a current I is supplied from the external peripheral end of the coil LA1 of the coil groups which are connected to each other in series, because the current I is supplied in the direction indicated by the arrow in FIG. 13, the currents are supplied into a portion which extends from the internal periphery to the external periphery of each of the coils LA1 and LA2 adjacent to each other, and into a portion which extends from the internal peripheral portion to the external peripheral portion of each of the coils LB1 and LB2 adjacent to each other, in the same direction.

Further, the coil groups which are adjacent to each other, which are, the coil groups G1 and G2, the coil groups G2 and G3, the coil groups G4 and G5, and the coil groups G5 and G6, are formed so that the winding directions thereof are reversed.

As described above, the yoke 20 to which a number of permanent magnets are fixed, the damper 22, the frame body 24 to which the vibrating diaphragm 26 on which multiple coils are situated is fixed, and the magnetic shield member 28 are assembled as a flat speaker unit. Namely, the peripheral edge of the speaker unit is supported by an unillustrated supporting member so that the damper 22 and the frame body 24 to which the vibrating diaphragm 26 on which a number of coils are situated is fixed are interposed between the yoke 20 and the magnetic shield member 28. As a result, the speaker unit is assembled as a flat speaker.

Figure 14:
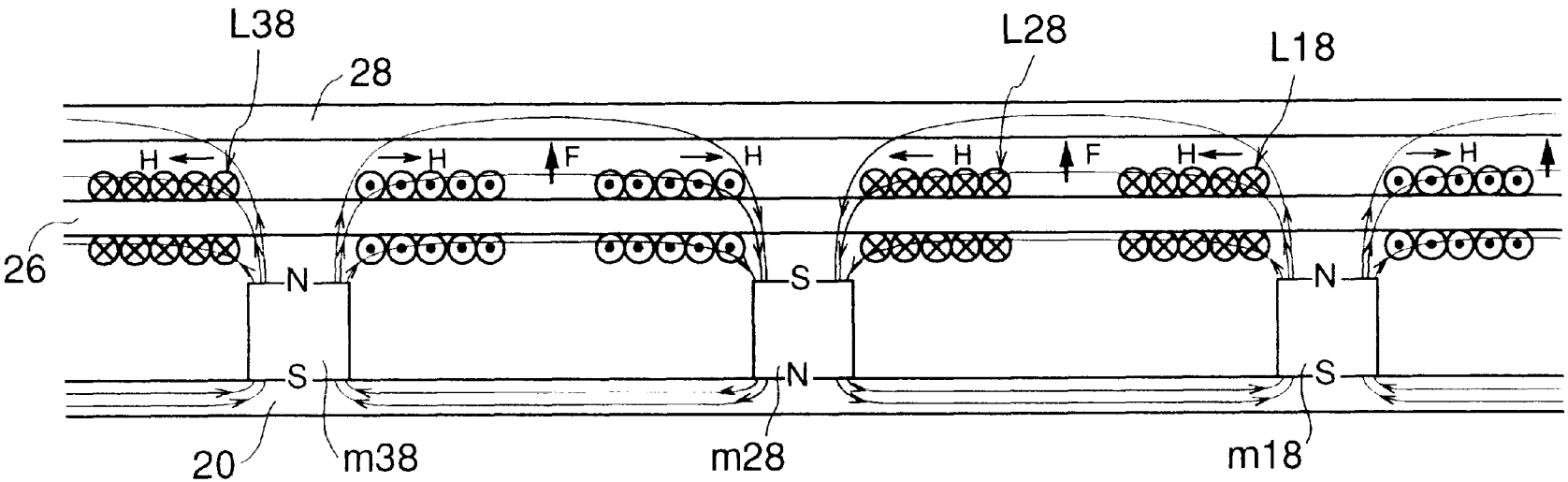
FIG. 14 is a cross sectional view taken along a plane passing through the permanent magnets mI8 to m38 according to the second embodiment of the present invention.

FIG. 14 is a cross sectional view of the flat speaker unit which has been assembled as described above and in which the damper is not shown. Since the polarities of the upper magnetic pole surfaces of the permanent magnets m18 and m28 adjacent to each other and the permanent magnets m28 and m38 adjacent to each other are different from each other and the orientations thereof are in the same direction, the magnetic flux which is generated from each permanent magnet is directed from an N magnetic pole surface to an S magnetic pole surface, and the magnetic flux of the area between the permanent magnets adjacent to each other is directed substantially in parallel with the surface of the vibrating diaphragm.

Because the pairs of coils L18, L28, and L38 are disposed on the top and rear surfaces of the vibrating diaphragm, the magnetic flux which is directed substantially in parallel with the surface of the vibrating diaphragm 26 links to each coil. When a current I in the direction which is shown in FIG. 13 is supplied into each coil, as shown in FIG. 14, the currents running in the same direction are supplied between the portions extending from the internal peripheral portions to the external peripheral portions of the coils adjacent to each other, and all of the coils are subjected to the force F applied in the same direction which is oriented so as to be perpendicular to the surface of the vibrating diaphragm so that the vibrating diaphragm moves in the direction perpendicular to the surface thereof. Accordingly, an electrical signal representing the sound is transferred to a coil, the vibrating diaphragm thereby vibrates in accordance with the electrical signal, and the sound signal can be output. Moreover, in FIGS. 13 and 14, H represents the direction of the magnetic flux.

At this time, as shown in FIG. 14, because the magnetic flux on the magnetic pole surface on the bottom surface of each permanent magnet exits from the N pole, passes through the magnetic path within the yoke 20, and enters into the S pole, a magnetic flux with a higher density can be generated on the magnetic pole surface of the top surface of the permanent magnet. Accordingly, a current having a small amplitude can be converted into a sound signal effectively, and the magnetic flux leakage to the outside of the magnetic pole surface of the bottom surface of the permanent magnet can be reduced.

As shown in FIG. 14, the magnetic flux which has reached the shield member of the magnetic pole surface above the top surface of each permanent magnet exits from the N pole, passes along the magnetic path within the magnetic shield member 28, and enters into the S pole. Accordingly, there is no magnetic flux leaking to the outside so that the magnetism can be shielded.

Further, because a number of holes are punched on the yoke 20 and the magnetic shield member 28, the sound signals pass these holes and are outputted from both surfaces of the flat speaker unit.

Figure 15:
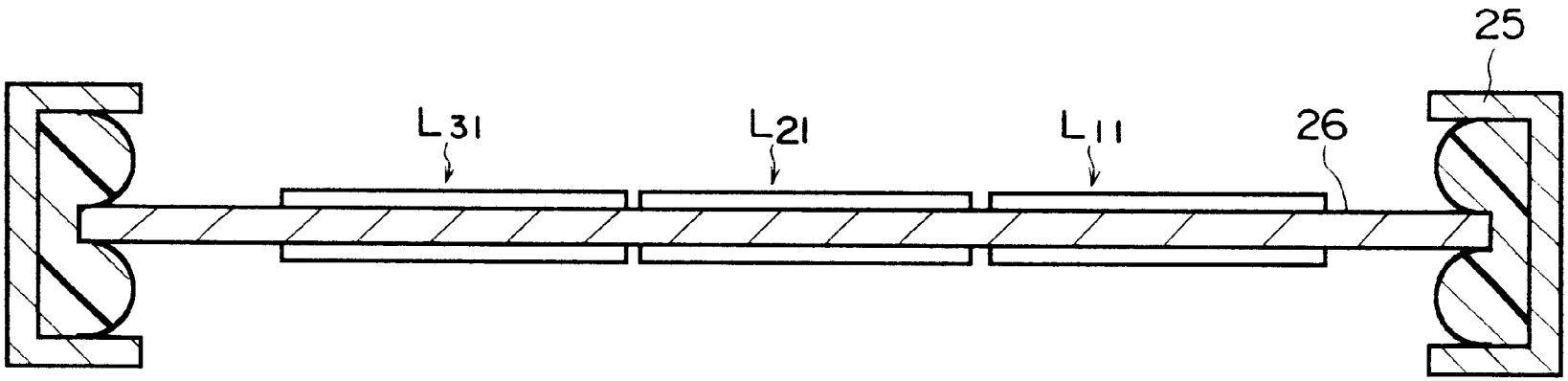
FIG. 15 is a cross sectional view taken along a plane which passes through pairs of coils L11 to L31 of another example where the vibrating diaphragm is fixed.

In the above description, an example in which the periphery of the vibrating diaphragm 26 is fixed to the frame body 24 has been explained. However, as shown in FIG. 15, the vibrating diaphragm 26 can be supported by a frame body 25 and accommodated therein. The frame body 25 has a groove portion formed thereon. The groove portion is formed into a U-shaped cross sectional configuration. The peripheral portion of the vibrating diaphragm 26 is sandwiched between fabrics which have been impregnated with a foaming urethane, a synthetic leather, or the like.

In accordance with each of the aforementioned embodiments, the impedance of the speaker can be set to a predetermined value by connecting coils to each other in series or parallel or by connecting coils to each other by mixing series and parallel connections. In this way, as described in the second embodiment, through an arbitrary connection of coils, voice coils can be grouped so as to vibrate collectively.

Next, a description of a third embodiment of the present invention will be given hereinafter. In accordance with the present embodiment, the above-described flat speaker unit is integrally formed with a sun visor which is provided in the interior portion of a vehicle and is structured as a flat speaker for the vehicle.

Figure 16:
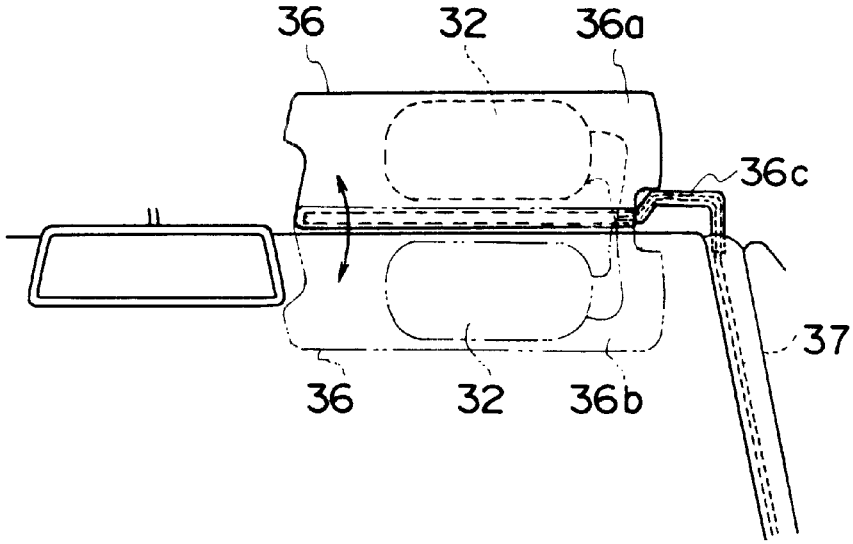
FIG. 16 is a schematic view of a flat speaker for a vehicle according to a third embodiment of the present invention.

As shown in FIG. 16, the flat speaker for a vehicle according to the present embodiment has a structure in which a speaker unit 32 is embedded in a sun visor 36 at a substantially central portion thereof.

Figure 11:
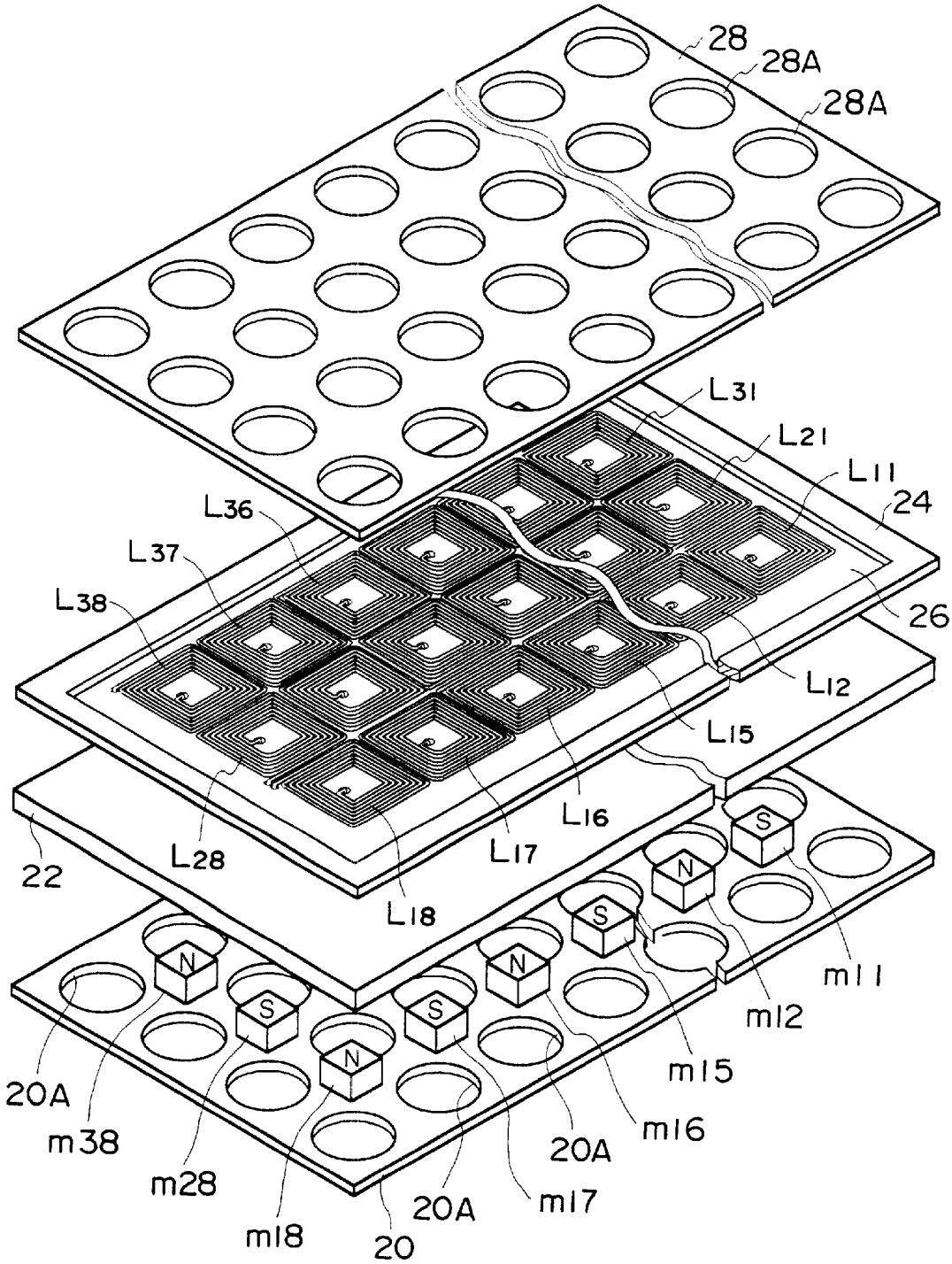
FIG. 11 is an exploded perspective view illustrating a second embodiment of the present invention.

A speaker unit which comprises the yoke 20 to which a number of permanent magnets are fixed, the damper 22, the frame body 24 to which is affixed the vibrating diaphragm 26 on which a number of coils are disposed, and the magnetic shield member 28, which are shown in FIG. 11, is used for the speaker unit 32. This speaker unit is coated with a protecting material which is permeable to sound (e.g., a fabric or a synthetic leather) so that the yoke 20 (or the magnetic shield member 28) is disposed at the front side of the sun visor so as to form a flat speaker for a vehicle which functions as a sun visor.

Two sun visors 36 are mounted to the left and the right of the upper portion of the front window of the vehicle so as to both be freely rotatable, by fastening members 36C. In order to screen the sunlight from the front, each of the fastening members 36C acts as a rotation axis so that the upper side portion of the sun visor 36 is rotated downwardly. Further, in the case of a sun visor which is mounted to the right side portion of the upper portion of the front window of the vehicle, in order to screen the sunlight from the right side of the vehicle, the fastening member 36C acts as the rotation axis so that the left side portion of the sun visor 36 is rotated toward the vehicle door.

The coils of the speaker unit pass through the inside of each of the fastening members 36C and are connected to a car navigation device which is housed in an instrument panel, by a cord 37 which is installed along the front pillar of the vehicle.

As described above, the speaker unit 32 is embedded in the central portion of the sun visor 36 so as to form the flat speaker for a vehicle. Accordingly, in an ordinary state, sound signals which have passed through the holes on the yoke 20 (or the magnetic shield member 28) are output from the front surface 36*a* of the sun visor 36. And in a state in which the sunlight is being screened by using the sun visor, the sound signals which have passed through the holes on the magnetic shield member 28(or the yoke 20) are outputted from the back surface 36*b* of the sun visor 36, so that the sound signals are output from both surfaces of the sun visor.

Moreover, the speaker unit which is shown in FIG. 8 may be used as a speaker unit.

Figure 17:
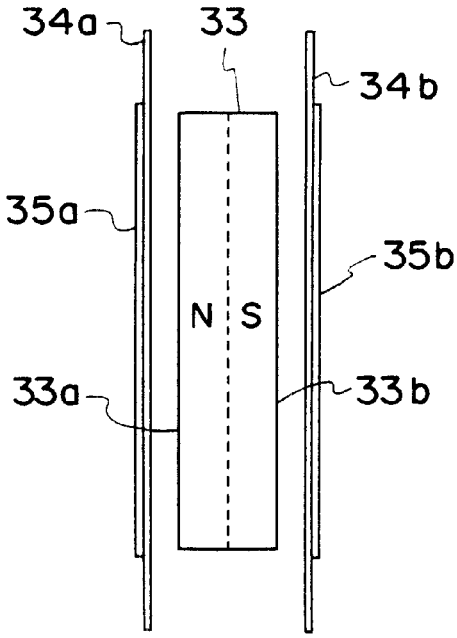
FIG. 17 is a cross sectional view of a speaker unit portion of the flat speaker for a vehicle according to the third embodiment of the present invention.

Next, another example of a speaker unit which is embedded in the sun visor will be explained. As shown in FIG. 17, the speaker unit comprises: a permanent magnet 33 which is formed in a bar shape or a plate shape and is positioned with the magnetic pole surface of the permanent magnet 33 facing the front surface side and the rear surface side of the sun visor; vibrating diaphragms 34*a* and 34*b;* and swirled voice coils 35*a* and 35*b*. The vibrating diaphragms 34*a* and 34*b* are provided so as to face the S magnetic pole surface and the N magnetic pole surface of the permanent magnet 33, respectively. The swirled voice coils 35*a* and 35*b* are disposed on each of the vibrating diaphragms 34*a* and 34*b* so as to face each other by interposing the permanent magnet 33 therebetween.

Each of the vibrating diaphragms 34*a* and 34*b* is formed by a high polymer film such as polyimide or the like, and is larger than the magnetic pole surface of the permanent magnet 33, and is mounted to a frame body (not shown) in a state in which a tensional force is applied to the vibrating diaphragms 34*a* and 34*b*.

Each of the voice coils 35*a* and 35*b* is formed in a swirled electrically conductive pattern, which is formed by etching a thin, copper film which has been deposited on the vibrating diaphragm and by coating the etched portion with an insulating layer. As described in the first and second embodiments of the present invention, these voice coils 35*a* and 35*b* are disposed on the vibrating diaphragm so that the internal periphery of each coil, i.e., the internal periphery of the swirl, is situated on the vibrating diaphragm in an area outside a position which corresponds to the external edge of the magnetic pole surface of the permanent magnet.

The electrically conductive pattern is formed at a length which can receive a predetermined wave length and can operate as an antenna to receive waves of traffic information such as VICS (Vehicle Information and Communication System) or the like.

The voice coils 35*a* and 35*b* are connected to a car navigation device which is accommodated in an instrumental panel by the cord 37. The cord 37 is inserted into the fastening members 36C and which is installed along the front pillar of the vehicle.

As described above, because the speaker unit 32 is embedded in the central portion of the sun visor, one vibrating diaphragm 34*a* is positioned at the front surface 36*a* of the sun visor 36. The other vibrating diaphragm 34*b* is positioned at the rear surface 36*b* of the sun visor 36.

Additionally, the speaker unit is covered with a protecting material which is permeable to sound (e.g., a fabric or a synthetic leather) so that a flat speaker for a vehicle is thereby formed and operates as a sun visor.

Figure 18:
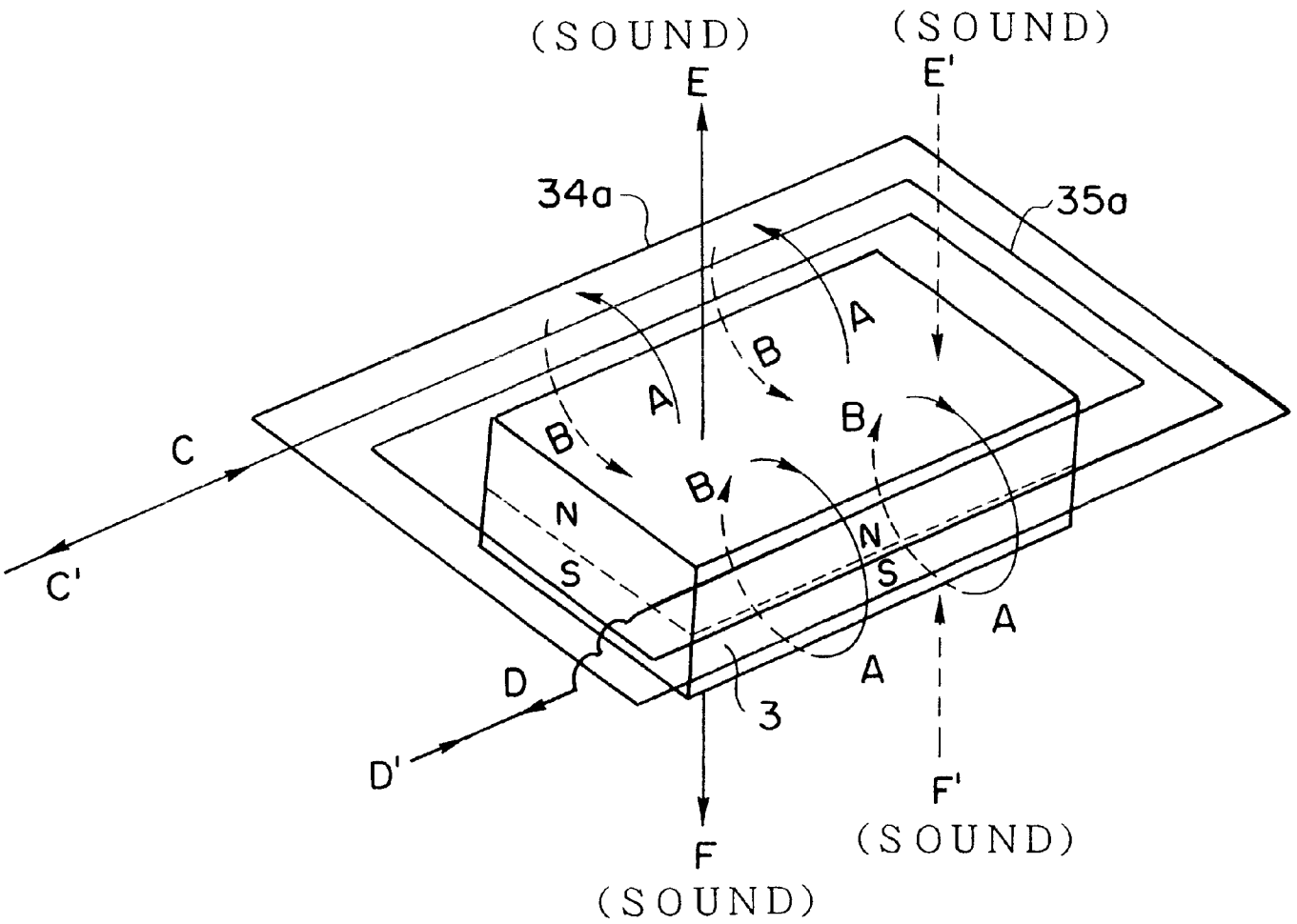
FIG. 18 is an explanatory view illustrating the direction of the magnet flux of the speaker unit portion of the flat speaker for a vehicle according to the third embodiment of the present invention.

As the magnetic flux is directed from N pole to S pole of the permanent magnet, the magnetic flux moving in the direction from the internal side to the external side of the voice coil (in the direction of A in FIG. 18) acts upon the voice coil 35*a* which faces an N magnetic pole surface, while the magnetic flux moving in the direction from the outside to the inside of the voice coil (in the direction B in FIG. 18) acts upon the voice coil 35*b* facing an S magnetic pole surface.

Therefore, as described above, when an in-phase electric current is supplied into each of the voice coils 35*a* and 35*b,* the electric current flows in the same direction in the portion of voice coil 35*a* as it flows in the corresponding portion of the voice coil 35*b*. When an electric current is supplied into the voice coils 35*a* and 35*b* in the direction of C to D, the voice coil 35*a* receives a force in the direction of E, and the voice coil 35*b* receives a force in the direction of F. Further, when an electric current is carried in the direction of D' to C', i.e., in the directions opposite to the aforementioned directions C and D, the voice coil 35*a* receives a force in the direction of E', and the voice coil 35*b* receives a force in the direction of F'.

As described above, when an in-phase electric current is supplied into each of the voice coils 35*a* and 35*b,* the vibrating diaphragms 34*a* and 34*b* always vibrate in the opposite direction to each other, and an in-phase voice is outputted from each of the vibrating diaphragms 34*a* and 34*b,* mainly from the speaker. Meanwhile, when a negative phase electric current is supplied into each of the voice coils 35*a* and 35*b,* the vibrating diaphragms 34*a* and 34*b* always vibrate in the same direction as each other, and voice is output from each of the vibrating diaphragms 34*a* and 34*b,* this voice being negative phase around the speaker.

Therefore, when a driver is driving an automobile and operates the car navigation device, the speaker unit inside the sun visor receives waves about traffic information, and the road information including maps are displayed on the display screen. At the same time, traffic information saying, e.g., "Turn right at the next intersection" or the like is output from the speaker unit as a voice message.

Because vibrating diaphragms are positioned on both surfaces of the sun visor, a voice message is outputted in the direction of the driver's face even when the rear surface of the sun visor is directed at the driver such as when the sun visor is turned to the left or to the font to protect the driver from the rays of the sun. This allows the driver to hear the voice message distinctly.

Moreover, when the voice coils are used as an antenna, in order to receive waves effectively, the total length of the voice coil may be adjusted to match the wave length by dividing the voice coil into a predetermined length.

As described above, an example in which voice coils receive waves of traffic information such as VICS or the like has been explained. However, radio or TV broadcasts may be received by the voice coils. In addition, in accordance with each of the above-described embodiments, a speaker which outputs the sound (voice) by energizing coils has been described. However, provided that an induced current is supplied into the coils by vibrating the vibrating diaphragm in accordance with Fleming's right-hand law, the speaker may be used as a microphone.

What is claimed is:

1. A flat acoustic converting device comprising:

a first magnet in which a first magnetic pole surface of said first magnet is disposed so as to be substantially in parallel with a predetermined face;

a second magnet which is disposed so as to be spaced apart from said first magnet at a predetermined distance and so as to be adjacent to said first magnet so that a second magnetic pole surface of the second magnet whose polarity is different from the polarity of said first magnetic pole surface is substantially in parallel with said predetermined face and faces the same side as the first magnetic pole surface of said first magnet;

a vibrating diaphragm which is disposed so as to face said predetermined face;

a first coil which is formed in a swirled shape, and which is disposed on said vibrating diaphragm at a position where the internal peripheral portion of the swirl is situated at an area adjacent to and including a position corresponding to the external edge of said first magnetic pole surface; and a second coil which is formed in a swirled shape, and which is disposed on said vibrating diaphragm at a position where the internal peripheral portion of the swirl is situated at an area adjacent to and including a position corresponding to the external edge of said second magnetic pole surface, wherein a current that is supplied into a portion of said first coil which is adjacent to said second coil and a current that is supplied into a portion of said second coil which is adjacent to said first coil are in the same direction.

2. A flat acoustic converting device comprising:

a first magnet in which a first magnetic pole surface of said first magnet is disposed so as to be substantially in parallel with a predetermined face;

a second magnet which is disposed so as to be spaced apart from said first magnet at a predetermined distance and so as to be adjacent to said first magnet so that a second magnetic pole surface of the second magnet whose polarity is different from the polarity of said first magnetic pole surface is substantially in parallel with said predetermined face and faces the same side as the first magnetic pole surface of said first magnet;

a vibrating diaphragm which is disposed so as to face said predetermined face;

a first coil which is formed in a swirled shape, and which is disposed on said vibrating diaphragm at a position where the internal peripheral portion of the swirl is situated at an area adjacent to and including a position corresponding to the external edge of said first magnetic pole surface; and a second coil which is formed in a swirled shape, and which is disposed on said vibrating diaphragm at a position where the internal peripheral portion of the swirl is situated at an area adjacent to and including a position corresponding to the external edge of said second magnetic pole surface, wherein, in the case in which the winding directions from the external peripheral portions to the internal peripheral portions of said first coil and said second coil are the same, the internal peripheral ends of said first coil and said second coil are connected to each other, or the external peripheral ends of said first coil and said second coil are connected to each other.

3. A flat acoustic converting device according to claim 2 wherein at least one of each of said first magnet and said second magnet are disposed in a scattered state on said predetermined face.

4. A flat acoustic converting device according to claim 2, wherein a plurality of rows of magnets are positioned in such a way that a row of magnets having the first magnet and second magnet disposed alternately along a first direction intersects with a second row of magnets having the first magnet and second magnet disposed alternately along a second direction.

5. A flat acoustic converting device according to claim 2 wherein at least one of said first magnets and said second magnets are formed in a plurality of configurations.

6. A flat acoustic converting device according to claim 2, wherein the area of said vibrating diaphragm on which said coils are situated has a hardness which is higher than the area of said vibrating diaphragm on which said coils are not situated.

7. A flat acoustic converting device according to claim 2, wherein said first magnet and said second magnet are disposed on a plate member which is made of a magnetic material.

8. A flat acustic converting device comprising:

a first magnet in which a first magnetic pole surface of said first magnet is disposed so as to be substantially in parallel with a predetermined face;

a second magnet which is disposed so as to be spaced apart from said first magnet at a predetermined distance and so as to be adjacent to said first magnet so that a second magnetic pole surface of the second magnet whose polarity is different from the polarity of said first magnetic pole surface is substantially in parallel with said predetermined face and faces the same side as the first magnetic pole surface of said first magnet;

a vibrating diaphragm which is disposed so as to face said predetermined face;

a first coil which is formed in a swirled shape, and which is disposed on said vibrating diaphragm at a position where the internal peripheral portion of the swirl is situated at an area adjacent to and including a position corresponding to the external edge of said first magnetic pole surface; and a second coil which is formed in a swirled shape, and which is disposed on said vibrating diaphragm at a position where the internal peripheral portion of the swirl is situated at an area adjacent to and including a position corresponding to the external edge of said second magnetic pole surface, wherein, in the case in which the winding directions from the external peripheral portions to the internal peripheral portions of said first coil and said second coil are different, the internal peripheral end of one of said first coil and said second coil, and the external peripheral end of the other of said first coil and said second coil are connected to each other, or the internal peripheral ends of said first coil and said second coil are connected to each other and the external peripheral ends of said first coil and said second coil are connected to each other.

9. A flat acoustic device according to claim 8, wherein at least one of each of said first magnet and said second magnet are disposed in a scattered state on said predetermined face.

10. A flat acoustic converting device according to claim 8, wherein a plurality of rows of magnets are positioned in such a way that a row of magnets having the first magnet and second magnet disposed alternately along a first direction intersects with a second row of magnets having the first magnet and second magnet disposed alternately along a second direction.

11. A flat acoustic device according to claim 8, wherein at least one of said first magnets and said second magnets are formed in a plurality of configurations.

12. A flat acoustic converting device according to claim 8, wherein the area of said vibrating diaphragm on which said coils are situated has a hardness which is higher than the area of said vibrating diaphragm on which said coils are not situated.

13. A flat acoustic converting device according to claim 8, wherein said first magnet and said second magnet are disposed on a plate member which is made of a magnetic material.

14. A flat acoustic converting device comprising:

a first magnet in which a first magnetic pole surface of said first magnet is disposed so as to be substantially in parallel with a predetermined face;

a second magnet which is disposed so as to be spaced apart from said first magnet at a predetermined distance and so as to be adjacent to said first magnet so that a second magnetic pole surface of the second magnet whose polarity is different from the polarity of said first magnetic pole is substantially in parallel with the predetermined face and faces the same side as the first magnetic pole surface of said first magnet;

a vibrating diaphragm which is disposed so as to face said predetermined face;

a first coil which is formed in a swirled shape, and which is disposed on said vibrating diaphragm at a position where the internal peripheral portion of the swirl is situated at an area adjacent to and including a position corresponding to the external edge of said first magnetic pole surface;

a second coil which is formed in a swirled shape winding in the reverse direction of said first coil, and which second coil is disposed on the vibrating diaphragm at a position overlapping said first coil in such a way that the internal peripheral portion of the swirl is situated at an area adjacent to and including a position corresponding to the external edge of the first magnetic pole surface, and the internal peripheral end of said second coil is connected to the internal peripheral end of said first coil;

a third coil which is formed in a swirled shape winding in the same direction as said second coil, and which third coil is disposed on said vibrating diaphragm in such a way that the internal peripheral portion of the swirl is situated at an area adjacent to and including a position corresponding to the external edge of the second magnetic pole surface, and the external peripheral end of said third coil is connected to the external peripheral end of said second coil; and a fourth coil which is formed in a swirled shape winding in the same direction as said first coil, and which fourth coil is disposed on said vibrating diaphragm at a position overlapping said third coil in such a way that the internal peripheral portion of the swirl is situated at an area adjacent to and including a position corresponding to the external edge of said second magnetic pole surface, and the internal peripheral end of said fourth coil is connected to the internal peripheral end of said third coil.

15. A flat acoustic converting device according to claim 14, wherein at least one of each of said first magnet are disposed in a scattered state on said predetermined face.

16. A flat acoustic converting device according to claim 14, wherein a plurality of rows of magnets are positioned in such a way that a row of magnets having the first magnet and second magnet disposed alternately along a first direction intersects with a second row of magnets having the first magnet and second magnet disposed alternately along a second direction.

17. A flat acoustic converting device according to claim 14, wherein at least one of said first magnets and said second magnets are formed in a plurality of configurations.

18. A flat acoustic converting device according to claim 14, wherein the area of said vibrating diaphragm on which said coils are situated has a hardness which is higher than the area of said vibrating diaphragm on which said coils are not situated.

19. A flat acoustic converting device according to claim 8, wherein said first magnet and said second magnet are disposed on a plate member which is made of a magnetic material.

20. A flat acoustic converting device according to claim 14, wherein said first coil is disposed on one surface of said vibrating diaphragm, said second coil is disposed on the other surface of said vibrating diaphragm so that the internal peripheral end of said second coil passes through said vibrating diaphragm and is connected to the internal peripheral end of said first coil, said third coil is disposed on said other surface of said vibrating diaphragm, and said fourth coil is disposed on said one surface of said vibrating diaphragm so that the internal peripheral end of said fourth coil passes through said vibrating diaphragm and is connected to the internal peripheral end of said third coil.

21. A flat acoustic converting device according to claim 20, wherein at least one of each of said first magnet and said second magnet are disposed in a scattered state on said predetermined face.

22. A flat acoustic converting device according to claim 20, wherein a plurality of rows of magnets are positioned in such a way that a row of magnets having the first magnet and second magnet disposed alternately along a first direction intersects with a second row of magnets having the first magnet disposed alternately along a second direction.

23. A flat acoustic converting device according to claim 20, wherein at least one of said first magnets and said second magnets are formed in a plurality of configurations.

24. A flat acoustic converting device according to claim 20, wherein the area of said vibrating diaphragm on which said coils are situated has a hardness which is higher than the area of said vibrating diaphragm on which said coils are not situated.

25. A flat acoustic converting device according to claim 20, wherein said first magnet and said second magnet are disposed on a plate member which is made of a magnetic material.

26. A flat acoustic converting device, comprising:

a magnet which has a first magnetic pole surface on one surface of said magnet and has a second magnetic pole surface whose polarity is different from the polarity of said first magnetic pole surface on the other surface thereof;

a first vibrating diaphragm which is disposed so as to correspond to said first magnetic pole surface of said magnet;

a second vibrating diaphragm which is disposed so as to correspond to said second magnetic pole surface of said magnet;

a first coil which is formed in a swirled shape, and which is disposed on said first vibrating diaphragm at a position where the internal peripheral portion of the swirl is situated at an area adjacent to and including a position corresponding to the external edge of said first magnetic pole surface; and a second coil which is formed in a swirled shape, and which is disposed on said second vibrating diaphragm at a position where the internal peripheral portion of the swirl is situated at an area adjacent to and including a position corresponding to the external edge of said second magnetic pole surface.

* * * * *

UNITED STATES PATENT AND TRADEMARK OFFICE

CERTIFICATE OF CORRECTION

PATENT NO. : 6,480,614 B1
DATED : November 12, 2002
INVENTOR(S) : Sakuzo Denda et al.

It is certified that error appears in the above-identified patent and that said Letters Patent is hereby corrected as shown below:

Title page, Item [54] and Column 1, line 1,
Please change from "PLANAR ACOUSTIC TRANSDUCER" to -- FLAT ACOUSTIC CONVERTING APPARATUS --

Signed and Sealed this

Third Day of June, 2003

JAMES E. ROGAN
*Director of the United States Patent and Trademark Office*